US007186492B2

(12) United States Patent
Hayashi et al.

(10) Patent No.: US 7,186,492 B2
(45) Date of Patent: Mar. 6, 2007

(54) TONER FOR ELECTROSTATIC CHARGE IMAGE DEVELOPMENT AND IMAGE FORMING METHOD

(75) Inventors: Kenji Hayashi, Hachioji (JP); Ken Ohmura, Hachioji (JP); Mikio Kouyama, Hino (JP)

(73) Assignee: Konica Minolta Holdings, Inc., Tokyo (JP)

( * ) Notice: Subject to any disclaimer, the term of this patent is extended or adjusted under 35 U.S.C. 154(b) by 271 days.

(21) Appl. No.: 10/776,791

(22) Filed: Feb. 11, 2004

(65) Prior Publication Data

US 2005/0175919 A1 Aug. 11, 2005

(51) Int. Cl.
*G03G 9/08* (2006.01)

(52) U.S. Cl. ..... 430/108.4; 430/111.4; 430/124

(58) Field of Classification Search ..... 430/108.4, 430/111.4, 124
See application file for complete search history.

(56) References Cited

U.S. PATENT DOCUMENTS 6,395,442 B1 * 5/2002 Hayashi et al. ..... 430/109.4
6,475,685 B2 * 11/2002 Uchida et al. ..... 430/99
6,677,097 B2 * 1/2004 Ohmura et al. ..... 430/110.3

FOREIGN PATENT DOCUMENTS

| | | | |
|---|---|---|---|
| EP | 1 385 062 | * | 1/2004 |
| JP | 07-114201 | | 5/1995 |
| JP | 10-097095 | | 4/1998 |
| JP | 2000-056503 | | 2/2000 |
| JP | 2001-042564 | | 2/2001 |
| JP | 2001-042568 | | 2/2001 |
| JP | 2001-109190 | | 4/2001 |
| JP | 2001-125313 | | 5/2001 |

* cited by examiner

*Primary Examiner*—John L Goodrow
(74) *Attorney, Agent, or Firm*—Lucas & Mercanti, LLP

(57) ABSTRACT

A toner includes at least a crystalline compound, a binding resin and coloring agent, wherein a differential heat quantity curve measured by a differential scanning calorimeter (DSC) has a clear endothermic peak at 50 to 100° C. in a first temperature rising process, and in a second temperature rising process, a peak area of the endothermic peak is reduced by ⅓ or less with respect to the peak area of the endothermic peak in the first temperature rising process. An image forming method employs the toner.

17 Claims, 4 Drawing Sheets

TONER FOR ELECTROSTATIC CHARGE IMAGE DEVELOPMENT AND IMAGE FORMING METHOD

The entire disclosure of JP Tokugan-2001-240507 filed on Jul. 13, 2001 including specification, claims, drawings and summary is incorporated herein by reference in its entirety.

BACKGROUND

1. Field of the Invention

The present invention relates to toner for electrostatic charge image development which is used for copying machines and printers, is good in image quality of fixed images and has high scratch resistance, an image forming method and an image formation apparatus.

2. Description of Related Art

Currently, an electrostatic charge image development system as typified by an electrophotographic system is used for most image formation apparatuses for obtaining high quality with high speed. This is because this system can respond to digital image formation and color image formation in addition to being capable of giving high speed and high quality images and thus gives good images stably for a long term.

However, in the electrostatic charge image development system, it is also the fact that several technical tasks are pointed out and improvement thereof is required. One of them is a problem of saving energy. One of reasons why the image formation apparatus by this system requires large energy is, of course, the use of a fuser (fixing unit) with high temperature. Thus, if the temperature at heat fixation can be lowered, it will be an effective measure for saving energy.

Conventionally, to fix at low temperature as storage stability is maintained, a technology where the fixing temperature is lowered using toner in which a low melting point crystalline compound is added has been developed, and the patent has been filed (e.g., JP Tokukai-2001-147550A). But, in such a technology, light scattering occurs due to a crystalline compound because a large amount of the crystalline compound is added, and thus transparency of finish images has been inferior.

Meanwhile, compact copying machines and printers with high speed have been actively developed, and in parallel therewith, machines comprising a double-side printing function and a bookbinding function have been actively developed.

There has been problematic in that when the above toner is used for such machines, an image and an image are overlapped before the temperature of fixed images can not be completely cooled, sticking of paper occurs, the overlapped images are stuck one another, and the image itself is impaired if they are forcedly peeled away.

SUMMARY

In order to dissolve the above-described problems, according to a first aspect of the present invention;

toner for developing a latent electrostatic image comprises at least a crystalline compound, a binding resin and coloring agent;

wherein a differential heat quantity curve measured by a differential scanning calorimeter (DSC) has a clear endothermic peak at 50 to 100° C. in a first temperature rising process, and in a second temperature rising process, a peak area of the endothermic peak is reduced by ⅓ or less with respect to the peak area of the endothermic peak in the first temperature rising process.

According to a first aspect of the present invention, transparency of the finish images can be made high even when the fixing temperature is made low.

Furthermore, according to the second aspect of the present invention, a image forming method is one fixing by heating a toner picture formed by using the above-described toner onto an image support.

According to the second aspect of the present invention, even in double-side printing using the above toner for developing electrostatic charge image, occurrence of the sticking between the images is prevented, and thus, an image of high image quality can be formed at a high speed.

BRIEF DESCRIPTION OF THE DRAWINGS

The present invention will become more fully understood from the detailed description given hereinbelow and the appended drawings which given by way of illustration only, and thus are not intended as a definition of the limits of the present invention, and wherein.

DETAILED DESCRIPTION OF THE PREFERRED EMBODIMENTS

Figure 1:
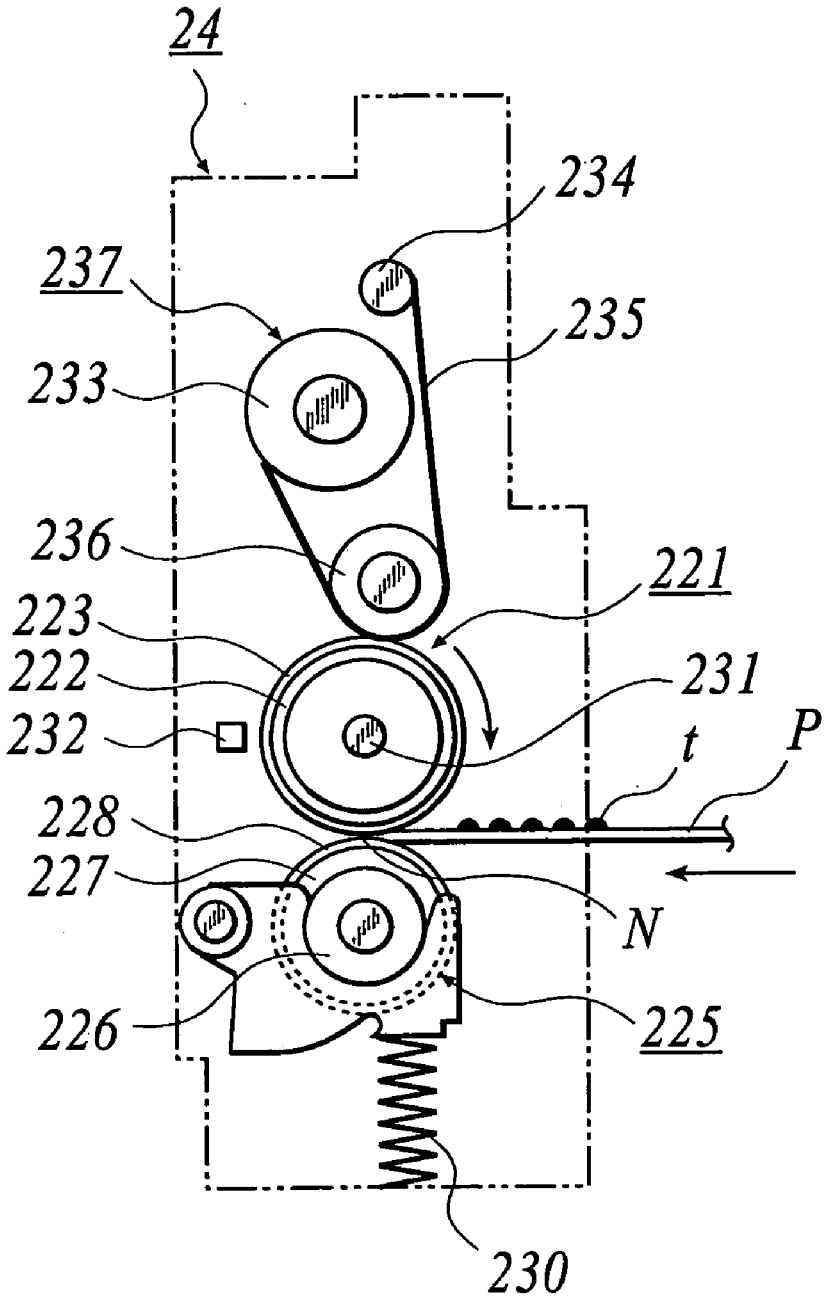
FIG. 1 is an illustrative view showing an outline of a configuration in one example of a fixing unit with heating roller mode.

According to the configurations of the invention, the toner where the fixing temperature is low, nonetheless the transparency of the finish images is high is obtained. Bases why no sticking between the images occurs also at the double-side printing by the image formation apparatus with high speed using the same are believed as follows.

For example, a case where an image support (transfer material) supporting an unfixed toner image is fixed through a heat roller fuser is thought of. It is believed that the crystalline compound is melted and a part thereof is compatibly dissolved with the binding resin before the binding resin in the toner reaches a dissolution temperature by heating in the toner as the invention where the particular crystalline compound is finely dispersed in toner particles. Portions where the crystalline compound has been present in the toner particles are bored, and viscosity and elastic modulus are reduced in binding resin portions where the crystalline compound is compatibly dissolved. When the toner particles in this state is heated and additionally pressed, they are rapidly melted and deformed, and sufficiently fixed to the image support.

Thereafter, in the toner image made by being cooled, since the particular crystalline compound of the invention is not separated from the binding resin again and stays in the binding resin, there is no irregular reflection of light at an interface of the binding resin portion and the crystalline compound fine particles, and thus the transparency of the toner image is enhanced. Besides, since the crystalline compound which stays in the binding resin is not eluted to the image surface at the paper discharge, no sticking between the images occur even at double-side printing.

The image forming method comprises steps where an electrostatic latent image formed on an electrostatic image supporter is developed by toner, a toner picture formed on the electrostatic image supporter is transferred onto an image support, and the transferred toner picture is heated, pressed and fixed by a heating roller and the like to obtain a fixed image.

The above toner comprises at least a binding resin, a coloring agent and a particular crystalline compound, wherein at least one clear endothermic peak exists at 50 to 100° C. in a first temperature rising process and this peak area is reduced by ⅓ or less in a second temperature rising process in a differential heat quantity curve (also referred to as DSC curve) of the particular crystalline compound measured by a differential scanning calorimeter. In this case, it is preferred that a peak value in the first temperature rising process is 2 J/g or more, further 5 J/g or more and especially preferably 10 J/g or more. It is preferred that this peak becomes less than 0.7 J/g and further less than 0.5 J/g in the second temperature rising process.

Wherein the peak area is an area comparted by the endothermic peak and a baseline.

In the toner of the invention, it can be said that the first temperature rising process corresponds to the aforementioned heat fixing step and the second temperature rising process responds to heat stability of the resulting fixed image.

That is, in the fixing step corresponding to the first temperature rising process, the crystalline compound with a low melting point instantaneously lowers melting viscosity of the toner, and thus it becomes possible to fix at low temperature. On the other hand, in the second temperature rising process, since the crystalline compound with a low melting point is compatibly dissolved with the binding resin, it does not inhibit optical transparency of the toner picture. Even when double sided images can not be cooled and overlapped at around the melting point of the crystalline compound, sticking between the images due to the eluted crystalline compound does not occur.

However when the other endothermic peak exists and it exists as a large endothermic peak in the second temperature rising process, if the paper is not discharged and overlapped at not more than the temperature of the peak, sticking and the like sometimes occur upon overlapping due to an influence of the substance having the large endothermic peak. Therefore, when the image support is overlapped and discharged onto a paper discharge unit after the image formation and fixation, if the paper temperature is higher than the peak temperature which is a clear endothermic peak in the first temperature rising process, and which area is reduced in the second temperature rising process, and the paper temperature is lower than a peak temperature of the largest endothermic peak in the second temperature rising process, then it becomes problematic. Here, the paper discharge unit used includes all sheet post-treatment units such as a paper discharge trey, a finisher and a bookbinding unit. Here, the paper temperature when the paper is discharged and overlapped is a temperature measured by inserting a thermocouple between a 19th paper and a 20th paper when 20 sheets of paper are discharged by overlapped.

Furthermore, one of the effects of the invention of obtaining transparent finish images makes the invention suitable for obtaining color images. When natural coloring color images are formed by color-overlapping using chromatic color coloring agents, specifically respective coloring agents of cyan, magenta and yellow, color toner image portions on the image support are large, further color images are overlapped and a toner adhering amount per unit area is large, and thus the sticking and the like easily occur. Therefore, the feature of the invention that anti-sticking property of images one another is high is especially exploited.

It goes without saying that this feature is further exerted when the bookbinding is performed immediately after the fixed images are discharged from the image formation apparatus.

[Method for Measurement and Definitions]

(1) Method for Measuring DSC Curve

In the invention, DSC curves in the toner and the crystalline compound are measured by a differential scanning calorimeter (DSC). A specific measurement apparatus can include DSC-7 supplied from Perkin Elmer Inc., and the like.

As a temperature rising/cooling condition, after keeping at 0° C. for one min, the temperature is raised up to 200° C. under a condition of 10° C./min (first temperature rising process). Then, after leaving at 200° C. for one min, the temperature is cooled to 0° C. under the condition of 10° C./min (first cooling process). Then after keeping at 0° C. for one min, the temperature is raised up to 200° C. under a condition of 10° C./min (second temperature rising process).

It is not preferred that the toner of the invention is exposed to high temperature before the heat fixation. Accordingly, a method for manufacturing the toner is not a kneading pulverization method conventionally used well, but it is preferable to be made up of particles obtained with a step where a monomer composition containing the particular crystalline compound and a polymerizable monomer is polymerized in aqueous medium.

It is preferable to obtain by associating fine particles made by directly polymerizing the monomer composition containing the particular crystalline compound and the polymerizable monomer in the aqueous medium, in the presence of coloring agent particles.

The crystalline compound of the invention is a compound which imparts the peak which reduces in the second temperature rising process to the toner, and in particular is preferably crystalline polyester. Among the crystalline compound, those where an acid value is from 1 to 8 mg/KOH are preferable, and the acid value is more preferably from 1.5 to 5 mg/KOH. When the acid value is more than 8 mg/KOH, there is a possibility that filming occurs whereas when it is less than 1 mg/KOH, probably because the compound is initially dissolved compatibly with the binding resin, the peak itself which reduces in the second temperature rising process is not sometimes seen in the first temperature rising process. Specific compounds are illustrated in subsequent paragraphs.

(2) Method for Measuring Acid Values

The acid value in the invention indicates the amount in milligram of potassium hydroxide required for neutralizing acid present in 1 g of crystalline compound, and indicates an amount of acid polar groups present at so-called molecular ends and the like.

This acid value can be measured by the method defined in JIS K0070. In the invention, a mixture solvent of toluene/ethanol (2:1) was used as the solvent for the measurement.

(1) Regent (a) Solvent

As a solvent for a sample, an toluene/ethyl alcohol mixture (=2:1) is used after neutralization immediately before use thereof with 0.1 mol/liter KOH-ethyl alcohol solution with phenolphthalein as an indicator.

(b) Phenolphthalein Solution 1 g of phenolphthalein is dissolved in 100 ml of ethyl alcohol (95 V/V %).

(c) 0.1 mol/liter KOH-ethyl Alcohol Solution 7.0 g of potasiumhydroxide is dissolved in a minimum amount of water and ethyl alcohol (95 V/V %) is added thereto up to a total volume of 1 liter to prepare a 0.1 mol/l-KOH/ethyl alcohol solution. After standing for 2 to 3 days, the solution is filtrated and standardized according to JIS-K8006.

(2) Operation

A same sample is weighed accurately in 1 to 20 g, and 100 ml of the solvent and several droplets of the phenolphthalein solution (as the indicator) are added thereto, followed by sufficient shaking until the sample is completely dissolved, if necessary by warming on the water bath. After cooling, the sample solution is titrated with the 0.1 mol/l-KOH/ethyl alcohol solution until an end point of the titration determined by continuation for 30 sec of the pale red color of the indicator.

(3) Calculation

The acid value (AV (mg KOH/g)) is calculated according to the following equation.

$$AV(\text{mg KOH/g})=B \text{ times } 5.611/S$$

B: amount of the 0.1 mol/l-KOH/ethyl alcohol solution (ml).

f: factor of the 0.1 mol/l-KOH/ethyl alcohol solution (−)

S: sample amount (g)

A content of the crystalline compound of the invention is from 3 to 40% by weight based on the toner, and especially preferably from 5 to 20% by weight. When it is less than 3% by weight, an effect to lower the fixing temperature is small whereas when it is more than 40% by weight, it is possible that impact resistance of the toner is reduced or storage property of the toner is deteriorated.

The temperature at a peak position in the first temperature rising process of the peak which reduces in the second temperature rising process is from 50 to 100° C., preferably from 55 to 70° C., and especially preferably from 58 to 65° C. When it is less than 50° C., storage stability with time is reduced whereas when it is more than 100° C., it is possible to occur that the effect to lower the fixing temperature is reduced.

It is easily understood from the above description that, when multiple peaks are present in the first temperature rising process, it is desirable that the peak which reduces in the second temperature rising process exists at the lowest temperature side according to the toner for electrostatic charge image development of the invention.

Hereinafter, materials, requirements, methods for fixing toner images, methods for image formation and an image forming apparatus used for the invention are illustrated in detail.

[1] Toner

The toner made by a so-called polymerization method is preferable than a kneading pulverization method to manufacturing the toner which is conventionally used well.

In the manufacture of toner by the polymerization method, it is preferable to make the temperature of polymerization and association a temperatures not more than the melting point of the crystalline compound and make a maturation step within 2 hours.

It is preferable to make phase separation at a degree where the phase of crystalline compound forms domains with a major axis of about 0.5 to 1.0 μm and a minor axis of about 0.01 to 0.1 μm when toner cross section is block-stained with ruthenium tetroxide.

That is, it is preferred that the toner of the invention is made up of particles obtained via a step of polymerizing the monomer composition containing the particular crystalline compound and the polymerizable monomer in the aqueous medium.

Besides, it is preferable to be obtained by associating fine particles made by directly polymerizing the monomer composition containing the particular crystalline compound and the polymerizable monomer in the aqueous medium, in the presence of coloring agent particles.

Furthermore, it is preferred that the toner of the invention is toner obtained by salting out/fusing composite resin particles obtained by multistage polymerization and the coloring agent particles and having a structure where the crystalline compound is contained in an area other than an outermost layer (midmost or intermediate layer) of the composite resin particle.

Composite Resin Particles

The composite resin particle for obtaining the toner of the invention can include:

(1) a composite resin particle having a midmost (nucleus) formed from a high molecular weight resin and an outer layer (shell) formed from a low molecular weight resin, wherein a releasing agent is contained in the midmost (nucleus), (2) a composite resin particle having a midmost (nucleus) formed from a high molecular weight resin, one or two or more intermediate layers formed from an intermediate molecular weight resin and an outer layer (shell) formed from a low molecular weight resin, wherein a releasing agent is contained in at least one layer of the intermediate layers, (3) a composite resin particle having a midmost (nucleus) formed from a high molecular weight resin and an outer layer (shell) formed from a low molecular weight resin, wherein a crystalline compound is contained in the midmost (nucleus), and (4) a composite resin particle having a midmost (nucleus) formed from a high molecular weight resin, one or two or more intermediate layers formed from an intermediate molecular weight resin and an outer layer (shell) formed from a low molecular weight resin, wherein a crystalline compound is contained in at least one layer of the intermediate layers.

The high molecular weight resin and the low molecular weight resin can be introduced into the toner of the invention by salting out/fusing the composite resin particles as the above.

Here, the "high molecular weight resin" which composes the midmost (nucleus) of the composite resin particle is a resin having a peak or a shoulder in the range of 100,000 to 1,000,000 in a molecular weight distribution measured by GPC (gel permeation chromatography), and those having the peak or the shoulder in the range of 120,000 to 500,000 are preferable.

Sufficient internal cohesive force (offset resistance at high temperature) can be imparted to the resultant toner by introducing such a high molecular weight resin.

The "low molecular weight resin" which composes the outer layer (shell) of the composite resin particle is a resin having a peak or a shoulder in the range of 1,000 to 50,000 in a molecular weight distribution measured by GPC, and those having the peak or the shoulder in the range of 3,000 to 20,000 are preferable.

Excellent fixing property (adhesive force to an image support) can be imparted to the resultant toner by introducing such a low molecular weight resin.

The "intermediate molecular weight resin" which composes the intermediate layer of the composite resin particle is a resin having a peak or a shoulder in the range of 25,000 to 150,000 in the molecular weight distribution measured by GPC. A peak molecular weight of the intermediate molecular weight resin which composes the single intermediate layer of the composite resin particle is required to be between a peak molecular weight of the high molecular weight resin which composes the midmost (nucleus) of the composite resin particle and a peak molecular weight of the low molecular weight resin which composes the outer layer (shell) of the composite resin particle.

This forms a molecular weight gradient between the midmost (nucleus) and the outer layer (shell) of the composite resin particle.

The molecular weight distribution of the resin which composes the toner of the invention is obtained from the molecular weight in terms of styrene measured using GPC.

As a method for measuring the molecular weight of the resin by GPC, 1 ml of tetrahydrofuran (THF) is added to 0.5 to 5.0 mg (specifically 1 mg) of a measurement test sample, and thoroughly dissolved by stirring at room temperature using a magnetic stirrer and the like. Then, the sample is treated with a membrane filter with a pore size of 0.45 to 0.50 μm, and subsequently injected to GPC.

As a measurement condition of GPC, a column is equalized at 40° C., THF is run at a flow rate of 1 ml/min, and about 100 μl of the sample at a concentration of 1 mg/ml is injected. It is preferable the column is composed of combination of commercially available polystyrene gel columns. For example, the columns can include the combinations of Shodex GPC KF-801, 802, 803, 804, 805, 806 and 807 supplied from Showa Denko K.K. and the combinations of TSK Gel G1000H, G2000H, G3000H, G4000H, G5000H, G6000H, G7000H and TSK guard column supplied from Tosoh Corporation, and the like. Also it is preferable to use a refractive index detector (IR detector) or a UV detector as a detector. In the molecular weight measurement of the sample, the molecular weight distribution which the sample has is calculated using a calibration curve determined using mono-disperse polystyrene standard particles. About 10 kinds of polystyrenes could be used for the calibration curve measurement.

As the polymerizable monomer for obtaining the composite resin particles which composes the toner of the invention, a radical polymerizable monomer is an essential constituent and crosslinker can be used, if necessary. Also, it is preferable to use at least one monomer selected from "radical polymerizable monomers having acidic groups" and "radical polymerizable monomers having basic groups".

(1) Radical Polymerizable Monomer

The radical polymerizable monomer is not especially limited, and the monomers according to the earlier development can be used in combination with one or two or more.

Such radical polymerizable monomers can include aromatic type vinyl monomers, (meth)acrylate ester type monomers, vinyl ester type monomers, vinyl ether type monomers, monoolefin type monomers, diolefin type monomers, olefin halide type monomers, and the like.

The aromatic type vinyl monomers include, for example, styrene type monomers such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene and 3,4-dichlorostyrene, and derivatives thereof.

The (meth)acrylate ester type monomers include, for example, methyl acrylate, ethyl acrylate, butyl acrylate, acrylate-2-ethylhexyl, cyclohexyl acrylate, phenyl acrylate, methyl methacrylate, ethyl methacrylate, butyl methacrylate, hexyl methacrylate, methacrylate-2-ethylhexyl, ethyl β-hydroxyacrylate, propyl γ-aminoacrylate, stearyl methacrylate, dimethylaminoethyl methacrylate, diethylaminoethyl methacrylate, and the like.

The vinyl ester type monomers include, for example, vinyl acetate, vinyl propionate, vinyl benzoate, and the like.

The vinyl ether type monomers include, for example, vinylmethylether, vinylethylether, vinylisobutylether, vinylphenylether and the like.

The monoolefin type monomers include, for example, ethylene, propylene, isobutyrene, 1-butene, 1-pentene, 4-methyl-1-pentene and the like.

The diolefin type monomers include, for example, butadiene, isoprene, chloroprene and the like.

The olefin halide type monomers include, for example, vinyl chloride, vinylidene chloride, vinyl bromide and the like.

(2) Crosslinker

A radical polymerizable crosslinker may be added as a crosslinker in order to improve properties of the toner. Such radical polymerizable crosslinkers include compounds having two or more unsaturated bonds such as divinylbenzene, divinylnaphthalene, divinylether, diethyleneglycol methacrylate, ethyleneglycol dimethacrylate, polyethyleneglycol dimethacrylate and diallyl phthalate.

As a percentage of the radical polymerizable crosslinker occupying in the monomer used (monomer mixture), it is preferable to be from 0.1 to 10% by weight.

(3) Radical Polymerizable Monomer Having Acid Groups

Radical polymerizable monomers having acid groups include a carboxyl group containing monomers such as acrylic acid, methacrylic acid, fumaric acid, maleic acid, itaconic acid, cinnamic acid, monobutyl maleate ester and monooctyl maleate ester, and sulfonic group-containing monomers such as styrene sulfonate, allyl sulfosuccinate and octyl allyl sulfosuccinate.

All or a part of the radical polymerizable monomer having the acid groups may be an alkali metal salt such as a salt of sodium, potassium or the like or an alkali earth metal salt such as a salt of calcium or the like.

As a percentage of the radical polymerizable monomer having the acid groups occupying in the monomer used (monomer mixture), it is preferable to be from 0.1 to 20% by weight, and more preferably it is from 0.1 to 15% by weight.

(4) Radical Polymerizable Monomer Having Basic Groups

As radical polymerizable monomer having basic groups, it is possible to include amine type compounds such as primary amine, secondary amine, tertiary amine and quaternary ammonium salts. As specific examples of such amine type compounds, it is possible to include dimethylaminoethyl acrylate, dimethylaminoethyl methacrylate, diethylaminoethyl acrylate, diethylaminoethyl methacrylate, and quaternary ammonium salts thereof, 3-dimethylaminophenyl acrylate, 2-hydroxy-3-methacryloxypropyltrimethyl ammonium salt, acrylamide, N-butylacrylamide, N,N-dibutylacrylamide, piperidylacrylamide, methacrylamide, N-butylmethacrylamide, N-octadecylacrylamide; vinylpyridine, vinylpyrrolidone; vinyl N-methylpyridinium chloride, vinyl N-ethylpyridinium chloride, N,N-diallylmethylammonium chloride, N,N-diallylethylammonium chloride, and the like.

As a percentage of the radical polymerizable monomer having basic groups occupying in the monomer used (monomer mixture), it is preferable to be from 0.1 to 20% by weight, and more preferably it is from 0.1 to 15% by weight.

(5) Chain Transfer Agent

A chain transfer agent generally used can be used for the purpose of adjusting the molecular weight of the resin which composes the composite resin particles.

The chain transfer agent is not especially limited, and for example, mercaptan such as octyl mercaptan, dodecyl mercaptan and tert-dodecyl mercaptan, n-octyl-3-mercaptopropionate ester, terpinolene, carbon tetrabromide, and a-methylstyrene dimer and the like are used.

(6) Polymerization Initiator

A radical polymerization initiator for obtaining the composite resin particles can be appropriately used so long as it is a water soluble radical polymerization initiator.

As specific examples of the radical polymerization initiator, for example, persulfate salts (potassium persulfate, ammonium persulfate, etc), azo type compounds (4,4'-azobis-4-cyanovaleric acid and salts thereof, 2,2'-azobis(2-amidinopropane) salts, etc), peroxide compounds, and the like are included.

Furthermore, the above radical polymerization initiator can be made into a redox type initiator by combining with a reducing agent if necessary. By the use of the redox type initiator, polymerization activity is increased, and thus it is possible to lower the polymerization temperature and further shortening of polymerization time is expected.

The polymerization temperature is not especially limited so long as it is not lower than the minimum temperature of radical generation of the polymerization initiator, but is set in the range of, for example, from 50 to 90° C. However, it is also possible to polymerize at the temperature not lower than ambient temperature by the use of the polymerization initiator which initiates at ambient temperature, such as a combination of hydrogen peroxide and the reducing agent (ascorbic acid, etc).

(7) Surfactant

In order to polymerize using the aforementioned radical polymerizable monomer, it is necessary to perform oil droplet dispersion in an aqueous medium using a surfactant. The available surfactant is not especially limited, and can include the following ionic surfactants as suitable examples.

The ionic surfactants can include sulfonate salts (sodium dodecylbenzenesulfonate, sodium arylalkylpolyethersulfonate, sodium 3,3-disulfonediphenyl urea-4,4-diazo-bis-amino-8-naphthol-6-sulfonate, sodium ortho-carboxybenzene-azo-dimethylaniline 2,2,5,5-tetramethyltriphenylmethane-4,4-diazo-bis-β-naphthol-6-sulfonate, etc), sulfate ester salts (sodium dodecylsulfate, sodium tetradecylsulfate, sodium pentadecylsulfate, sodium octylsulfate, etc), fatty acid salts (sodium oleate, sodium laurate, sodium caprate, sodium caprylate, sodium caproate, potassium stearate, calcium oleate, etc), and the like.

Also, non-ionic surfactants can be used. Specifically, it is possible to include polyethylene oxide, polypropylene oxide, a combination of polypropylene oxide and polyethylene oxide, ester of polyethyleneglycol and higher fatty acid, alkylphenolpolyethylene oxide, ester of higher fatty acid and polypropylene oxide, sorbitan ester, and the like.

A weight mean particle size (dispersion particle diameter) of the composite resin particles is preferably in the range of 10 to 1000 nm, and more preferably in the range of 30 to 300 nm.

This weight mean particle size is a value measured using an electrophoretic light scattering spectrophotometer, "ELS-800" (supplied from Otsuka Electronics Co., Ltd.).

A glass transition temperature (Tg) of the resin components (resins introduced as the composite resin particles) which composes the toner of the invention is preferably in the range of 48 to 74° C. and more preferably from 52 to 65° C.

It is preferred that a softening point of the resin components is in the range of 95 to 140° C.

Here, the glass transition temperature (Tg) of the resin components is referred to a value measured by DSC, and an intersecting point of a baseline and a slope of the endothermic peak is rendered a transition point. Specifically, using DSC, a sample is heated up to 100° C., kept at the temperature for 3 min, and subsequently cooled to room temperature at 10° C./min. Then, when this sample is measured at a temperature rising rate of 10° C./min, the intersecting point of an extension line of the base line not more than the glass transition point and a tangent line which exhibits a maximum slope between a starting part of a peak and a vertex of the peak is shown as the glass transition point.

Here, as a measuring apparatus, DSC-7 supplied from Perkin Elmer Inc. and the like can be used.

The softening point of the resin component is referred to a value measured using a flow tester. Specifically, the temperature corresponding to ½ of a height from an outflow starting point to an outflow terminating point when a sample of 1 $cm^3$ is melted and let out using the flow tester "CFT-500" (supplied from Shimadzu Corporation) under a condition of a dice pore diameter of 1 mm, a length of 1 mm, a lord of 20 $kg/cm^2$ and a temperature rising speed at 6° C./min is shown as the softening point.

(8) Releasing Agent

It is preferred that the toner of the invention is made up of association type toner particles obtained by salting out/fusing the composite resin particles containing a releasing agent in the area (midmost or intermediate layer) other than the outermost layer and the coloring agent particles.

As the releasing agent which composes the toner of the invention, various ones according to the earlier development and capable of being dispersed in water can be exemplified. Specifically, olefin type waxes such as waxes of polypropylene and polyethylene, natural waxes such as carnauba wax and rice wax, amide type waxes such as fatty acid bisamide wax can be included.

As the suitable releasing agent which composes the toner of the invention, the crystalline ester compounds (hereinafter referred to as "particular ester compound") represented by the following general formula (1) can be included.

$$R^1—(OCO—R^2)_n; \qquad \text{General formula (1)}$$

(wherein $R^1$ and $R^2$ each represent hydrocarbon group with 1 to 4 carbons, which may have substituents, and n is an integer of 1 to 4.)

In the general formula (1) which represents the particular ester compound, $R^1$ and $R^2$ each represent hydrocarbon group which may have substituents.

The number of carbons in the hydrocarbon group $R^1$ is from 1 to 40, preferably from 1 to 20, and more preferably from 2 to 5.

The number of carbons in the hydrocarbon group $R^2$ is from 1 to 40, preferably from 16 to 30, and more preferably from 18 to 26.

In the general formula (1), n is an integer of 1 to 4, preferably from 2 to 4, more preferably from 3 to 4, and in particular preferably 4.

The particular ester compound can be suitably synthesized by a dehydration condensation reaction of alcohol and carboxylic acid.

As specific examples of the particular ester compound, compounds shown in the following formulae 1) to 22) can be exemplified.

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6) $CH_3—(CH_2)_{20}—COO-(CH_2)_2—CH(CH_3)—CH_2—O—CO—(CH_2)_{20}-CH_3$

7) $CH_3—(CH_2)_{22}—COO-(CH_2)_2-CH(CH_3)—CH_2—O—CO—(CH_2)_{22}—CH_3$

8) $CH_3-(CH_2)_{22}—COO—(CH_2)_2-CH(CH_3)—CH_2—O—CO—(CH_2)_{22}—CH_3$

9) $CH_3-(CH_2)_{26}—COO—(CH_2)_2-CH(CH_3)—CH_2—O—CO—(CH_2)_{26}—CH_3$

10) $CH_2—O—CO—(CH_2)_{26}—CH_3$
$CH—O—CO—(CH_2)_{26}—CH_3$
$CH_2—O—CO—(CH_2)_{26}—CH_3$

11) $CH_2—O—CO—(CH_2)_{22}—CH_3$
$CH—O—CO—(CH_2)_{22}—CH_3$
$CH_2—O—CO—(CH_2)_{22}—CH_3$

12) $CH_2—OH$
$CH—O—CO—(CH_2)_{26}—CH_3$
$CH_2—O—CO—(CH_2)_{26}—CH_3$

13) $CH_2—OH$
$CH—O—CO—(CH_2)_{22}—CH_3$
$CH_2—O—CO—(CH_2)_{22}—CH_3$

14) $CH_2—OH$
$CH—OH$
$CH_2—O—CO—(CH_2)_{26}—CH_3$

-continued

15) $CH_2—OH$
$CH—OH$
$CH_2—O—CO—(CH_2)_{22}—CH_3$

16) $CH_3—(CH_2)_{26}—COO—CH_2-C(CH_3)—CH_2—O—CO—(CH_2)_{26}—CH_3$
$CH_2-O—CO—(CH_2)_{26}-CH_3$

17) $CH_3-(CH_2)_{20}—COO—CH_2—C(CH_2CH_3)—CH_2—O—CO—(CH_2)_{20}—CH_3$
$CH_2—O—CO—(CH_2)_{20}—CH_3$

18) $CH_3-(CH_2)_{26}—COO—CH_2—C(CH_2—O—CO—(CH_2)_{20}—CH_3)—CH_2—O—CO—(CH_2)_{26}—CH_3$
$CH_2—O—CO—(CH_2)_{26}—CH_3$

19) $CH_3-(CH_2)_{20}—COO—CH_2—C(CH_2—O—CO—(CH_2)_{20}—CH_3)—CH_2—O—CO—(CH_2)_{20}—CH_3$
$CH_2—O—CO—(CH_2)_{20}—CH_3$

20) $CH_3-(CH_2)_{18}—COO—CH_2—C(CH_2—O—CO—(CH_2)_{18}—CH_3)—CH_2—O—CO—(CH_2)_{18}—CH_3$
$CH_2—O—CO—(CH_2)_{18}—CH_3$

21) $CH_3-(CH_2)_{16}—COO—CH_2—C(CH_2—O—CO—(CH_2)_{16}—CH_3)—CH_2—O—CO—(CH_2)_{16}—CH_3$
$CH_2—O—CO—(CH_2)_{16}—CH_3$

22) $CH_3-(CH_2)_{20}—COO—CH_2—C(CH_2—O—CO—CH_3)—CH_2—O—CO—CH_3$
$CH_2—O—CO—CH_3$

A containing percentage of the releasing agent which composes the toner of the invention is typically from 1 to 30%, preferably from 2 to 20% and more preferably from 3 to 15% by weight.

It is preferred that the releasing agent which reduces adhesive force between particles is contained in the outermost layer of the composite resin particles according to the invention. The composite resin particles firmly adhere one another in a salting out/fusing step to form the fused particles with high crushability index.

[2] Crystalline Compound

It is preferred that the toner of the invention is made up of association type toner particles obtained by salting out/fusing the composite resin particles containing a crystalline compound in the area (midmost or intermediate layer) other than the outermost layer and the coloring agent particles.

As a crystalline compound, especially as the crystalline compound, especially crystalline polyester is preferable, and a number average molecular weight is preferably from 1,500 to 15,000, and more preferably from 2,000 to 10,000.

When the crystalline polyester has the number average molecular weight in the range of 1,500 to 15,000, in the resultant toner, compatibility with a binding resin (amorphous high molecule) for exerting entire melt viscosity reduction thereof is enhanced in a melting state and fixing property is enhanced at the lower temperature side. When this number mean molecular weight is less than 1,500, the melt viscosity of the crystalline polyester is excessively reduced, if anything, a compatible state easily becomes uneven and it becomes difficult to be able to enhance the fixing property. On the other hand, when the number mean molecular weight exceeds 15,000, it takes a long time to melt the crystalline polyester, the compatible state also becomes uneven, and thus an enhancement effect of the fixing property becomes low.

Here, the number average molecular weight of the crystalline polyester is referred to a value obtained from the molecular weight measured according to the following condition.

(Condition)

Machine model used: "LC-6A" (supplied from Shimadzu Corporation)

Column: "Ultrastyragel Plus"

Analysis temperature: 60° C.

Solvent: m-Cresol/chlorobenzene=3/1 (volume ratio)

Calibration curve: Standard polystyrene calibration curve

The melt viscosity (melt viscosity at a melting point+20° C.) of the crystalline polyester is preferably 300 dPa·s or less, and more preferably 250 dPa·s or less.

When the melt viscosity of the crystalline polyester is 300 dPa·s or less, in the resulting toner, it becomes possible to reduce the melt viscosity of the entirety including the binding resin, and the fixing property is enhanced. When this melt viscosity exceeds 300 dPa·s, the enhancement effect of fixing property becomes low because the entire melt viscosity becomes high.

Here, the melt viscosity (melt viscosity at a melting point+20° C.) of the crystalline polyester is referred to a value measured by a cone and plate viscometer.

In order to exert the effects of the invention, it is preferred that the binding resin and the crystalline polyester exist independently one another. That is, the crystalline compound is rapidly dissolved, in a melting state thereof, an action to dissolve the binding resin works, consequently the entire melt viscosity of the toner can be reduced, and the fixing property can be enhanced. By existing independently one another, it becomes possible to suppress the reduction of elastic modulus at the high temperature side, and thus the offset resistance is not impaired.

Constituents of Crystalline Polyester

As the crystalline polyester, polyester obtained by reacting aliphatic diol and aliphatic dicarboxylic acid (including acid anhydride and acid chloride) is preferable.

Diol used for obtaining the crystalline polyester can include ethyleneglycol, diethyleneglycol, triethyleneglycol, 1,2-propyleneglycol, 1,3-propyleneglycol, 1,4-butanediol, 1,4-butenediol, neopentylglycol, 1,5-pentaneglycol, 1,6-hexanediol, 1,4-cyclohexanediol, 1,4-cyclohexanedimethanol, dipropyleneglycol, polyethyleneglycol, polypropyleneglycol, polytetramethyleneglycol, bisphenol A, bisphenol Z, hydrogenated bisphenol A, and the like.

Dicarboxylic acid used for obtaining the crystalline polyester can include oxalic acid, malonic acid, succinic acid, glutaric acid, adipic acid, pimelic acid, suberic acid, azelaic acid, sebacylic acid, maleic acid, fumaric acid, citraconic acid, itaconic acid, glutaconic acid, n-dodecylsuccinic acid, n-dodecenylsuccinic acid, isododecylsuccinic acid, isododecenylsuccinic acid, n-octylsuccinic acid, n-octenylsuccinic acid, acid anhydride or acid chloride thereof.

Especially preferable crystalline polyester can include polyester obtained by reacting 1,4-cyclohexanedimethanol and adipic acid, polyester obtained by reacting 1,6-hexanediol and sebacylic acid, polyester obtained by reacting ethyleneglycol and succinic acid, polyester obtained by reacting ethyleneglycol and sebacylic acid, and polyester obtained by reacting 1,4-butanediol and succinic acid. In these, the polyester obtained by reacting 1,4-cyclohexanedimethanol and adipic acid is the most preferable.

[3] Coloring Agent

The toner of the invention is obtained by salting out/fusing the above composite resin particles and coloring agent particles.

The coloring agent (coloring agent particles given to salting out/fusing with the composite resin particles) which composes the toner of the invention can include various inorganic pigments, organic pigments, and dyes.

As the inorganic pigments, it is possible to use pigments according to the earlier development. Specific inorganic pigments are exemplified below.

As black pigments, for example, carbon black such as furnace black, channel black, acetylene black, thermal black and lamp black, and further magnetic powder such as magnetite and ferrite are used.

It is possible to select a single or plurality of these inorganic pigments if desired. An addition amount of the pigments is from 2 to 20% by weight based on the polymer, and preferably the amount of from 3 to 15% by weight is selected.

When the toner is used as magnetic toner, the aforementioned magnetite can be added. In this case, it is preferable to add 20 to 60% by weight to the toner in terms of imparting the given magnetic property.

As the organic pigments and the dyes which preferably form color images in the invention, ones accroding to the earlier development can be used. Specific organic pigments and dyes are exemplified below.

Pigments for magenta or red include C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166, C.I. pigment red 177, C.I. pigment red 178, C.I. pigment red 222, and the like.

Pigments for orange or yellow include C.I. pigment orange 31, C.I. pigment orange 43, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, C.I. pigment yellow 138, C.I. pigment yellow 180, C.I. pigment yellow 185, C.I. pigment yellow 155, C.I. pigment yellow 156, and the like.

Pigments for green or cyan include C.I. pigment blue 15, C.I. pigment blue 15:2, C.I. pigment blue 15:3, C.I. pigment blue 16, C.I. pigment blue 60, C.I. pigment green 7, and the like.

As the dyes, C.I. solvent red 1, 49, 52, 58, 63, 111 and 122, C.I. solvent yellow 19, 44, 77, 79, 81, 82, 93, 98, 103, 104, 112 and 162, C.I. solvent blue 25, 36, 60, 70, 93 and 95, and the like can be used, and mixtures thereof can be also used.

It is possible to select a single or plurality of these organic pigments and dyes and combine if desired. An addition amount of the pigment is from 2 to 20% by weight based on the polymer, and preferably the amount of from 3 to 15% by weight is selected.

The coloring agent (coloring agent particles) which composes the toner of the invention may be surface-modified. Here, as a surface modifying agent, one according to the earlier development can be used, and specifically, silane coupling agents, titanium coupling agents, aluminium coupling agents and the like can be preferably used.

The silane coupling agents include alkoxy silane such as methyltrimethoxysilane, phenyltrimethoxysilane, methylphenyldimethoxysilane and diphenyldimethoxysilane, siloxane such as hexamethyldisiloxane, γ-chloropropyltrimethoxysilane, vinyltrichlorosilane, vinyltrimethoxysilane, vinyltriethoxysilane, γ-methacryloxypropyltrimethoxysilane, γ-glycidoxypropyltrimethoxysilane, γ-mercaptopropyltrimethoxysilane, γ-aminopropyltriethoxysilane, γ-ureidopropyltriethoxysilane, and the like.

The titanium coupling agents include, for example, TTS, 9S, 38S, 41B, 46B, 55, 138S, 238S which are commercially available as a brand name of "Plenact" supplied from Ajinomoto Co., Inc., A-1, B-1, TOT, TST, TAA, TAT, TLA, TOG, TBSTA, A-10, TBT, B-2, B-4, B-7, B-10, TBSTA-400, TTS, TOA-30, TSDMA, TTAB, and TTOP which are commercially available articles supplied from Nippon Soda Co., Ltd., and the like.

The aluminium coupling agents include, for example, "Plenact AL-M" supplied from Ajinomoto Co., Inc., and the like.

The addition amount of these surface modifying agents is preferably from 0.01 to 20%, and more preferably from 0.1 to 5% by weight based on the coloring agent.

A method for modifying the surface of coloring agent particles can include a method where a surface-modifying agent is added into a dispersion solution of the coloring agent particles and reacted by heating.

The coloring agent particles of which surface is modified are collected by filtration, then wash treatment and filtration treatment with the same solvent are repeated, and subsequently drying treatment is given.

[4] Other Additives Added to Toner

Internal additives such as charge controlling agent in addition to the crystalline polyester may be contained in the toner particles which compose the toner of the invention.

The charge controlling agent contained in the toner particles includes nigrosine type dye, metallic salts of naphthenic acid or higher fatty acid, alkoxylated amine, quaternary ammonium chloride, azo type metallic complex, salicylate metallic salts or metallic complex thereof, and the like.

It is preferred that the toner of the invention is made up of association type toner particles obtained by salting out/fusing the composite resin particles containing the releasing agent and the coloring agent particles.

One or more domains of a releasing agent exist in a submicron area corresponding to the size of composite resin particle in this toner particle, and the releasing agent is finely dispersed in the toner particle.

By making like this, a sufficient amount of the releasing agent is introduced, and there is no variation in amounts of the releasing agent among the toner particles which compose the toner.

Furthermore, in the composite resin particle given to the salt out/fusion, the releasing agent which is prone to reduce adhesive force between the particles is contained in the area (midmost or intermediate layer) other than the outermost layer, furthermore the outermost layer is formed from a low molecular weight resin with good adhesiveness, and thus the composite resin particles firmly adhere one another to form fused particles (toner particles) with high crushability index. Therefore, the toner of the invention becomes one which is excellent in pulverization resistance.

Additionally, the toner preferably has a shape with concavoconvex surface at the time of manufacture thereof. When the toner has such shape, the toner is the association type toner obtained by fusing the composite resin particles and the coloring agent particles in the aqueous medium, differences of the shape and surface property between the toner particles are extremely small and consequently the surface property easily becomes uniform. Thus, it is difficult to make a difference in fixing property between the toner particles, and it is also possible to well retain the fixing property.

[5] External Additives

The toner of the invention can be configured as it is, but to improve fluidity, electrostatic property, cleaning property and the like, the toner of the invention may be configured by adding so-called external additives to the toner particles. Such external additives are not especially limited, and can include various inorganic fine particles, organic fine particles and lubricants.

The inorganic fine particles which can be used as the external additives can include ones according to the earlier development. Specifically, silica fine particles, titanium fine particles, alumina fine particles and the like can be preferably used. It is preferred that these inorganic fine particles are hydrophobic.

Specific examples of the silica fine particles include commercially available articles such as R-805, R-976, R-974, R-972, R-812 and R-809 supplied from Nippon Aerosil Co., Ltd., HVK-2105 and H-200 supplied from Hoechst AG., commercially available articles such as TS-720, TS-530, TS-610, H-5 and MS-5 supplied from Cabot Corporation, and the like.

Specific examples of the titanium fine particles include, for example, commercially available articles such as T-805 and T-604 supplied from Nippon Aerosil Co., Ltd., commercially available articles such as MT-100S, MT-100B, MT-500BS, MT-600, MT-600SS and JA-1 supplied from Tayka Corporation, commercially available articles such as TA-300SI, TA-500, TAF-130, TAF-510 and TAF-510T supplied from Fuji Titanium Industry Co., Ltd., commercially available articles such as IT-S, IT-OA, IT-OB and IT-OC supplied from Idemitsu Kosan Co., Ltd., and the like.

Specific examples of the alumina fine particles include, for example, commercially available articles such as RFY-C and C-604 from Nippon Aerosil Co., Ltd., a commercially available article such as TTO-55 supplied from Ishihara Sangyo Co., Ltd., and the like.

The organic fine particles which can be used as the external additive can include spherical fine particles where a number mean primary particle diameter is from about 10 to about 2000 nm. Constituent materials of such organic fine particles can include polystyrene, polymethylmethacrylate, styrene-methylmethacrylate copolymer and the like.

Lubricants which can be used as the external additive can include metal salts of higher fatty acids. Specific examples of metal salts of such higher fatty acids include metal salts of stearic acid such as zinc stearate, aluminium stearate, copper stearate, magnesium stearate and calcium stearate, metal salts of oleic acid such as zinc oleate, manganese oleate, iron oleate, copper oleate and magnesium oleate, metal salts of palmitic acid such as zinc palmitate, copper palmitate, magnesium palmitate and calcium palmitate, metal salts of linoleic acid such as zinc linoleate and calcium linoleate, metal salts of ricinoleic acid such as zinc ricinolate and calcium ricinolate, and the like.

It is preferred that the addition amount of the external additives is from about 0.1 to about 5% by weight based on the amount of the toner.

[6] Methods for Manufacturing Toner

The method for manufacturing of the invention includes a process (I) of obtaining composite resin particles where a releasing agent is contained in an area other than an outermost layer by multistage polymerization and a process (II) of salting out/fusing the composite resin particles obtained in this process (I) and coloring agent particles.

One example of the method for manufacturing of the invention is comprised of (1) a multistage polymerization process (I) for obtaining the composite resin particles where the crystalline polyester is contained in the area (midmost or intermediate layer) other than the outermost layer;

(2) a salting out/fusing process (II) for obtaining toner particles by salting out/fusing the composite resin particles and coloring agent particles;

(3) a filtrating/washing where the toner particles are separated by filtration from a toner particle dispersion system, and surfactants and the like are eliminated from the toner particles;

(4) a drying where the toner particles given the washing treatment are dried; and (5) adding where external additives to the toner particles given the drying treatment.

The respective processes are illustrated below.

[Multistage Polymerization Process (I)]

This multistage polymerization step (I) is a step of manufacturing the composite resin particles by a multistage polymerization method where a coating layer (n+1) made up of polymer of monomer (n+1) is formed on the surface of resin particles (n).

It is preferable to employ the multistage polymerization method of three stages or more polymerizations in the light of stability of the manufacture and crushability index of the resulting toner.

The polymerization method suitable for forming resin particles or a coating layer which contains crystalline polyester can include the method where a dispersion solution is prepared by dispersing as oil droplets a monomer solution in which the crystalline polyester is dissolved in a monomer in an aqueous medium in which a surfactant is dissolved at a concentration not more than a critical micelle concentration utilizing mechanical energy, and radical polymerization is performed in the oil droplets by adding an aqueous polymerization initiator to the resultant dispersion solution (hereinafter referred to as "mini-emulsion method" herein). In place of adding the aqueous polymerization initiator or along with adding the aqueous polymerization initiator, an oil-soluble polymerization initiator may be added in the monomer solution.

According to the mini-emulsion method where the oil droplets are mechanically formed, differently from usual emulsification polymerization, the crystalline polyester dissolved in an oil phase is not dissociated, and a sufficient amount of the crystalline polyester can be introduced in the formed resin particles or coating layer.

For particle size of the composite resin particles obtained in this polymerization process (I), it is preferred that a weight mean particle size measured using an electrophoretic light scattering spectrophotometer, "ELS-800" (supplied from Otsuka Electronics Co., Ltd.) is in the range of 10 to 1000 nm.

A glass transition temperature (Tg) of the composite resin particles is preferably in the range of 48 to 74° C., and more preferably from 52 to 64° C.

It is preferred that a softening point of the composite resin particles is in the range of 95 to 140° C.

[Salting Out/Fusing Process (II)]

This salting out/fusing process (II) is a process of obtaining amorphous (non-spherical) toner particles by salting out/fusing (simultaneously performing salt out/fusion) the composite resin particles obtained by the multistage polymerization process (I) and the coloring agent particles.

In this salting out/fusing process (II), the internal additive particles (fine particles with a number mean primary particle diameter of about 10 to 1000 nm) such as a charge controlling agent may be salted out/fused along with the composite resin particles and the coloring agent particles.

The coloring agent particles are applied to the salting out/fusing treatment in a dispersed state in an aqueous medium. The aqueous medium in which the coloring agent particles are dispersed can include an aqueous solution in which a surfactant is dissolved at a concentration not less than a critical micelle concentration (CMC).

Here, as the surfactant, it is possible to use the same surfactant as used in the multistage polymerization process (I).

A dispersing machine used for the dispersion treatment of the coloring agent particles is not especially limited, and preferably includes, "Clearmix" (supplied from M Technique Co., Ltd.), which is an agitation apparatus comprising a rotor which rotates at a high speed an ultrasonic dispersing machine, a mechanical homogenizer, Manton Gaulin, press dispersing machines such as press type homogenizers, medium type dispersing machines such as Gettman mill and diamond fine mill.

To salt out and fuse the composite resin particles and the coloring agent particles, it is necessary to add a salting-out agent (coagulant) at a concentration not less than a critical cohesive concentration in the dispersion solution in which the composite resin particles and the coloring agent particles are dispersed and to heat this dispersion solution up to a temperature not less than the glass transition temperature (Tg) of the composite resin particles.

The range of temperature suitable for salting out/fusing is from (Tg+10) to (Tg+50° C.), and especially preferably from (Tg+15) to Tg+40° C.)

Also in order to effectively perform the fusion, an organic solvent which unlimitedly dissolves in water may be added.

Here, the "salting-out agent" used upon salting out/fusing can include alkali metal salts and alkali earth metal salts.

Alkali metals which constitutes the salting-out agent include lithium, potassium, sodium and the like, and alkali earth metals which constitutes the salting-out agent include magnesium, calcium, strontium, barium and the like. Among them, potassium, sodium, magnesium, calcium and barium are preferable.

Counterions (anions which compose salts) of the alkali metals and the alkali earth metals include chloride ion, bromide ion, iodide ion, carbonate ion, sulfate ion, and the like.

"Organic solvents which unlimitedly dissolve in water" which can be added upon salting out/fusing include methanol, ethanol, 1-propanol, 2-propanol, ethyleneglycol, glycerine, acetone, and the like. Among them, alcohols including carbons of three or less such as methanol, ethanol, 1-propanol and 2-propanol are preferable, and especially 2-propanol is preferable.

When the salting-out agent is added to the dispersion solution in which the composite resin particles and the coloring agent particles are dispersed, the temperature of the dispersion solution is preferably not more than the glass transition temperature (Tg) of the composite resin particles, specifically preferably in the range of 5 to 55° C., and more preferably from 10° C. to 45° C.

In the case where the temperature of the dispersion solution, when the salting-out agent is add, becomes more than the glass transition temperature (Tg) of the composite resin particles, it becomes difficult to control particle sizes and extremely large particles are easily produced.

As described above, it is necessary to add the salting-out agent with stirring the dispersion solution when the temperature of the dispersion solution in which the composite resin particles and the coloring agent particles are dispersed is not more than the glass transition temperature (Tg) of the composite resin particles, subsequently start rapidly heating of the dispersion solution, and make the temperature not less than the glass transition temperature (Tg) of the composite resin particles in this salting out/fusing process (II).

Filtrating/Washing

In this filtrating/washing step, a filtration treatment where the toner particles are separated by filtration from the dispersion system of toner particles obtained in the above processes and a wash treatment where extraneous matters such as surfactant and salting-out agent are eliminated from the toner particles separated by the filtration (cake-like assembly) are given.

Here, the methods for filtration treatment include centrifugation methods, reduced-pressure filtration methods using Nutshe and the like, filtration methods using filter press and the like, and is not especially limited.

Drying

This process is a process where a drying treatment is given to the toner particles to which the wash treatment has been given.

As a dryer used in this step, a spray dryer, a vacuum freezing dryer, a reduced-pressure dryer, and the like can be included, and it is preferable to use a standing shelf dryer, a moving type shelf dryer, a fluidized bed dryer, a rotating dryer, a agitating dryer, and the like.

A water content of the toner particles after the drying treatment is preferably 5% or less, and more preferably 2% or less by weight.

When the toner particles after the drying treatment are agglutinated one another by weak attracting force between the particles, a cracking treatment may be given to the agglutinate. Here, as a cracking treatment apparatus, mechanical cracking apparatuses such as a jet mill, Henschel mixer, a coffee mill, and a food processor can be used.

Addition of External Additives

This process is a process where external additives are added to the toner particles given the drying treatment.

Apparatuses used for adding the external additives can include various mixing apparatuses according to the earlier development, such as a turbula mixer, Henschel mixer, Nauta mixer, and a V-type mixer.

[7] Physical Properties of Toner

The toner of the invention is toner containing a resin, a releasing agent and a coloring agent, and crushability index of 0.1 to 0.8 according to the above definition.

The "crushability index" is an index representing the crushability of the toner particle, which is concretely determined by the following procedure.

Procedure

Into a 2 liter polyethylene pot, 30 g of toner sample and 100 g of glass beads GB503M manufactured by Toshiba-Barotini Co., Ltd. are charged, and stirred for 60 seconds by a tabular mixer. Then the glass beads are separated by a sieve of 300 meshes. Thereafter, the number ratio in percent of fine particles having a diameter of from 2 μm to 4 μm in the whole particles is measured and the index is determined by the following equation.

$$(\text{Crushability index})=(N-N_0)/60$$

In the equation, N is the number ratio in percent of the fine particles having a diameter of from 2 μm to 4 μm after the stirring, and $N_0$ is the number ratio in percent of the fine particles having a diameter of from 2 μm to 4 μm before the stirring.

The "number ration in percent of the fine particles" is measured by Coultar Multisizer. In concrete, Coultar Multisizer connected with a personal computer through an interface manufactured by Nikkaki Co., Ltd. for outputting the particle diameter distribution is used. An aperture of 100 μm is used in the Coultar Multisizer, and the volume distribution of toner particles each having a diameter of 2 μm or more, for example from 2 μm to 40 μm, is measured and the index is calculated.

Toner having a desired crushability index can be obtained by, for example, controlling molecular weight of the resin employed in the outermost layer of the composite resin particles, and controlling temperature of fusion and stirring condition during the coagulation process.

The toner where the crushability index is more than 0.8 can not has sufficient pulverization resistance. When such toner is given to the image formation for a long term, filming, photographic fog, carrier spent and the like occur due to fine powder produced by pulverization.

On the other hand, the toner where the pulverization strength index is less than 0.1 has a tendency that the minimum fixation temperature increases, and can not sometimes fulfill requests for downsizing of copying machines and making low consumption electric power.

For particle sizes of the toner of the invention, a volume mean particle size is preferably from 3 to 10 μm, and more preferably from 3 to 8 μm. This particle size can be controlled by the concentration of coagulant (salting-out agent), the addition amount of organic solvent, a fusion time, a composition of polymer in the method for manufacturing the toner described below.

When the volume mean particle size is in the range of 3 to 10 μm, the toner fine particles with large adhesive force which adhere to a heating member by taking a flight and generate offset in a fixing step are reduced, furthermore the image quality of half tone is improved and the image quality of thin lines and dots is improved because transfer efficiency is increased.

The volume mean particle size can be measured using a Coulter Counter TA-II, Coulter Multisizer, SLAD 1100 (laser diffraction type particle size measuring apparatus supplied from Shimadzu Corporation), and the like.

In the invention, Coulter Multisizer was used, and used by connecting an interface (supplied from Nikkaki-Bios Co., Ltd.) and a personal computer. The particle size distribution and the mean particle size were calculated using one with 100 μm as an aperture in the Coulter Multisizer by measuring the volume distribution of the toners of 2 μm or more (e.g., from 2 to 40 μm).

As the toner of the invention, the percentage of the toner particles of 3 μm or less is preferably 20% or less by number, and more preferably the percentage of the toner particles of 2 μm or less is 10% or less by number. The amount of such toner particles (fine powder toner) can be measured using an electrophoretic light scattering spectrophotometer, "ELS-800" supplied from Otsuka Electronics Co., Ltd. In order to adjust a particle size distribution as such, it is preferable to shorten the temperature control in the salting out/fusing. Specifically, the temperature is raised as rapidly as possible, that is, a temperature rising rate is increased. As this condition, it is preferred that a time until the completion of temperature rising is less than 30 min, preferably less than 10 min, and the temperature rising rate is from 1 to 15° C./min.

It is preferred that the toner of the invention is the toner where a sum (M) of a relative frequency (m1) of toner particles included in the most frequent rank and a relative frequency (m2) of toner particles included in the second most frequent rank following to the most frequent rank is 70% or more in histogram which represents a particle size distribution based on numbers in multiple ranks with intervals of 0.23 in a horizontal axis when the particle size of the toner particle is D (μm) and the horizontal axis represents natural logarithm lnD.

When the sum (M) of the relative frequency (m1) and the relative frequency (m2) is 70% or more, since variance in the particle size distribution of the toner particles becomes small, it is possible to definitely suppress occurrence of selective development by the use of the toner for the image forming.

In the invention, the histogram showing the particle size distribution based on the numbers is the histogram obtained by dividing the natural logarithm lnD (D: particle size of individual toner particle) into the multiple ranks with intervals of 0.23 (0 to 0.23; 0.23 to 0.46; 0.46 to 0.69; 0.69 to 0.92; 0.92 to 1.15; 1.15 to 1.38; 1.38 to 1.61; 1.61 to 1.84; 1.84 to 2.07; 2.07 to 2.30; 2.30 to 2.53; 2.53 to 2.76 . . . ). This histogram was made by forwarding particle size data of samples measured by Coulter Multisizer according to the following condition to a computer via I/O unit and processing by a particle size distribution analysis program in the computer.

As the measuring condition;

(1) Aperture: 100 μm (2) Sample preparation method: An appropriate amount of a surfactant (neutral detergent) is added to 50 to 100 ml of an electrolytic solution (Isoton R-11 supplied from Coulter Scientific Japan), stirred and 10 to 20 mg of a measurement sample is added thereto. The sample is prepared by treating this system using an ultrasonic dispersing machine for one minute.

The toner of the invention is suitably used for forming semi-gloss images.

Here, the "semi-gloss image" is referred to an image where a standard glossiness is from 17 to 37. In the invention, the standard glossiness is represented by a value measured by a gloss meter, VGS-1D (supplied from Nippon Denshoku Kogyo Co., Ltd.) at an incident angle of 750 according to JIS-Z8741-1983 method 2 in an image portion where an image forming material (toner) coats 90% or more of an image forming support. Measurement of a percentage of the coated image forming support with the image forming material was performed using a high speed color image analyzer, SPICCA (supplied from Nippon Avionics CO., Ltd.).

In the invention, the standard glossiness of the semi-gloss image is from 17 to 37, and preferably from 17 to 27. When the standard glossiness is less than 17, brightness of the image is lacked and sufficient texture is not obtained. On the other hand, when the standard glossiness exceeds 37, a surface regular reflection portion is excessively large, sufficient texture is not obtained, and reality is insufficient. Additionally, when the surface is smooth, an incident light quantity to an inside becomes large, deterioration of the coloring agent easily occurs, and image deterioration with time course occurs.

[8] Developer

The toner of the invention may be used as a one component developer or a two component developer.

When used as the one component developer, a non-magnetic one component developer and a magnetic one component developer where magnetic particles of about 0.1 to 0.5 μm are contained in the toner are included, and both can be used.

Also, it is possible to use as the two component developer by blending a carrier. In this case, it is possible to use materials according to the earlier development as a magnetic particle of carrier, such as metals such as iron, ferrite and magnetite, alloys of those metals with metals such as aluminium and lead. Especially, ferrite particle is preferable. For the above magnetic particles, the volume mean particle size thereof is preferably from 15 to 100 μm, and more preferably from 25 to 80 μm.

The volume mean particle size of the carrier can be measured by a laser diffraction type particle. size distribution measurement apparatus comprising a wet type dispersing machine, "Helos" (supplied from Sympatec GmbH) as a representative.

As the carrier, those where the magnetic particles are further coated with a resin or so-called resin dispersion type carriers where the magnetic particles are dispersed in the resin are preferable. A resin composition for coating is not especially limited, and for example, olefin type resins, styrene type resins, styrene-acryl type resins, silicone type resins, ester type resins, or fluorine-containing polymer type resins or the like are used. A resin for constituting the resin dispersion type carrier is not especially limited, one according to the earlier development can be used, and, for example, it is possible to use styrene-acryl type resins, polyester resins, fluorine type resins, phenol resins and the like.

[9] Fixing Method and Fixing Unit (Fuser)

FIG. 1 is an illustrative view showing an outline of a configuration in one example of a fixing unit with heating roller mode. This fixing unit 24 comprising a heating roller 221 as a first rotation body arranged to border on a face (upper face of a recording material P in FIG. 1) where unfixed toner picture of the recording material P is supported and a pressing roller 225 as a second rotation body installed such that a fixing nip N portion (fixing area) is formed by being pressed and closely contacted to this heating roller 221 by a press spring 230.

And inside the heating roller 221, for example a halogen heater lamp is installed as a heating source 231, and a temperature detection member 232 is installed in close vicinity to the surface of the heating roller 221 at a downstream location in a moving direction (clockwise) of the heating roller 221 from the fixing nip portion N.

The heating roller 221 is composed of a cylindrical core grid 222 extending to a width direction (vertical direction for a paper face) of the fed recording material P and a releasing layer 223 made up of, for example a fluorine resin, which is formed on a peripheral face of this core grid 222.

Materials which composes the core grid 222 are not especially limited and can include metals such as aluminium, iron and copper or alloys thereof.

The fluorine resin which composes the releasing layer 223 includes, for example, PTFE (polytetrafluoroethylene), PFA (tetrafluoroethylene-perfluoroalkylvinylether copolymer resins) and the like.

A thickness of the releasing layer 223 is, for example, preferably from 10 to 100 μm, and more preferably from 15 to 30 μm.

The pressing roller 225 is composed of the core grid 226 made of a metal, an elastic layer 227 formed on the surface of this core grid 226, and a releasing layer 228 formed on the surface of this elastic layer 227.

A metal which composes the core grid 226 is not especially limited, and can include, for example, metals such as iron, aluminium and copper or alloys thereof.

An elastic body which composes the elastic layer 227 is not especially limited, and can include various soft rubbers such as urethane rubber and silicone rubber, and sponge rubber.

A thickness of the elastic layer 227 is, for example, preferably from 3 to 10 mm, and more preferably from 5 to 8 mm.

The releasing layer 228 can be composed by a tube made up of, for example, a fluorine resin, e.g., tetrafluoroethylene-perchloroalkylvinylether copolymer resin (PFA).

A thickness of the releasing layer 228 is, for example, preferably from 20 to 100 μm, and more preferably from 30 to 70 μm.

To the fixing unit 24 used in the invention, if necessary, a cleaning mechanism which cleans the toner on the heating roller 221 may be imparted. In this case, it is possible to utilize a method for cleaning by supplying silicone oil to the heating roller 221 by a pad, a roller, a web and the like where the silicone oil is impregnated. In the example shown in the figure, the cleaning mechanism which supplies the silicone oil by the web 235 extended by a feed roller 233 and a winding roller 234 is installed. In FIG. 1, 236 is a backup roller to contact the web 235 with the heating roller 221.

Figure 2:
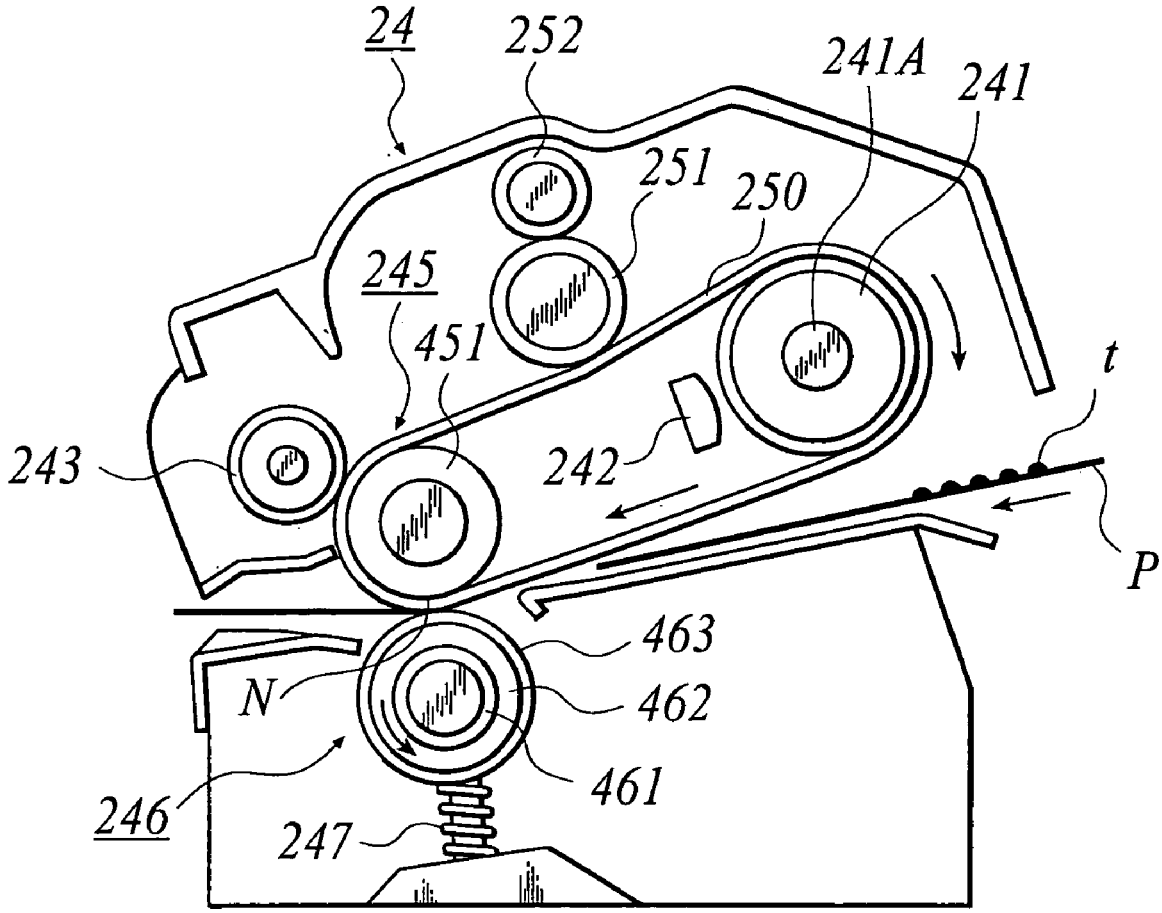
FIG. 2 is an illustrative view showing an outline of a configuration in one example of a fixing unit with heat fixing belt mode.

FIG. 2 is an illustrative view showing an outline of a configuration in one example of a fixing unit with heat fixing belt mode. This fixing unit 24 comprises an endless heat fixing belt 250 as a first rotation body, which is extended by a heating roller 241 and an upper pressing roller 245 to be moved by circulating and a lower pressing roller 246 as a second rotation body, which is attached to a spring made up of, for example, a coiled spring and forms a fixing nip portion N by contacting to the heat fixing belt 250 by the upper pressing roller 245. In FIG. 2, 242 is a temperature detection member for detecting a temperature of the heating roller 241, 243 is a cleaning roller which eliminates the toner which has adhered to the heat fixing belt 250, and t is an unfixed toner picture supported on a recording material P.

The heating roller 241 is made of, for example, Teflon (R), and a heating source 241A made up of, for example, a halogen lamp is installed inside.

For the upper pressing roller 245, the entirety thereof is composed of, for example, an elastic member 451 with low hardness. Here, the elastic member 451 is, for example, one where Asker C hardness is 500 or less, and specific examples thereof include silicone rubber, silicone sponge rubber and the like.

The lower pressing roller 246 is composed of a thermal conductive base substance 461 made of, for example, aluminium, an elastic layer 462 formed on the surface of this thermal conductive base substance 461, and a releasing layer 463 formed on the surface of this elastic layer 462.

An elastic body which composes the elastic layer 462 is not especially limited, and can include various soft rubbers such as urethane rubber and silicone rubber, and sponge rubber.

A thickness of the elastic layer 462 is, for example, preferably from 0.5 to 10 mm, and more preferably from 2 to 5 mm.

The releasing layer 463 is made of, for example, a fluorine resin, and, for example, is made up of a tube made of tetrafluoroethylene-perchloroalkylvinylether copolymer resin (PFA).

A thickness of the releasing layer 463 is, for example, preferably from 20 to 100 μm, and more preferably from 30 to 70 μm.

The heat fixing belt 250 is composed of, for example, an endless belt-shaped metal base substance obtained by electrotyping nickel or an endless belt shaped resin base substance made of heat resistant polyimide resin, an elastic layer formed on the surface of the base substance made of, for example, silicone rubber, and a releasing layer formed on the surface of this elastic layer, which is made of, for example, fluorine resin.

A thickness of the releasing layer is, for example, preferably from 10 to 100 μm, and more preferably from 15 to 30 μm.

An upper section of the heat fixing belt 250 can be made into a configuration where an oil applying roller 251 which applies oil onto the heat fixing belt 250 and a cleaning roller 252 which cleans the surface of the oil applying roller 251 are installed. The oil applying roller 251 and the cleaning roller 252 are not sometimes required depending on releasing property of the toner used and material quality of the releasing layer on the surface of the heat fixing belt 250.

[10] Image Forming Method and Image Forming Apparatus

Figure 3A:
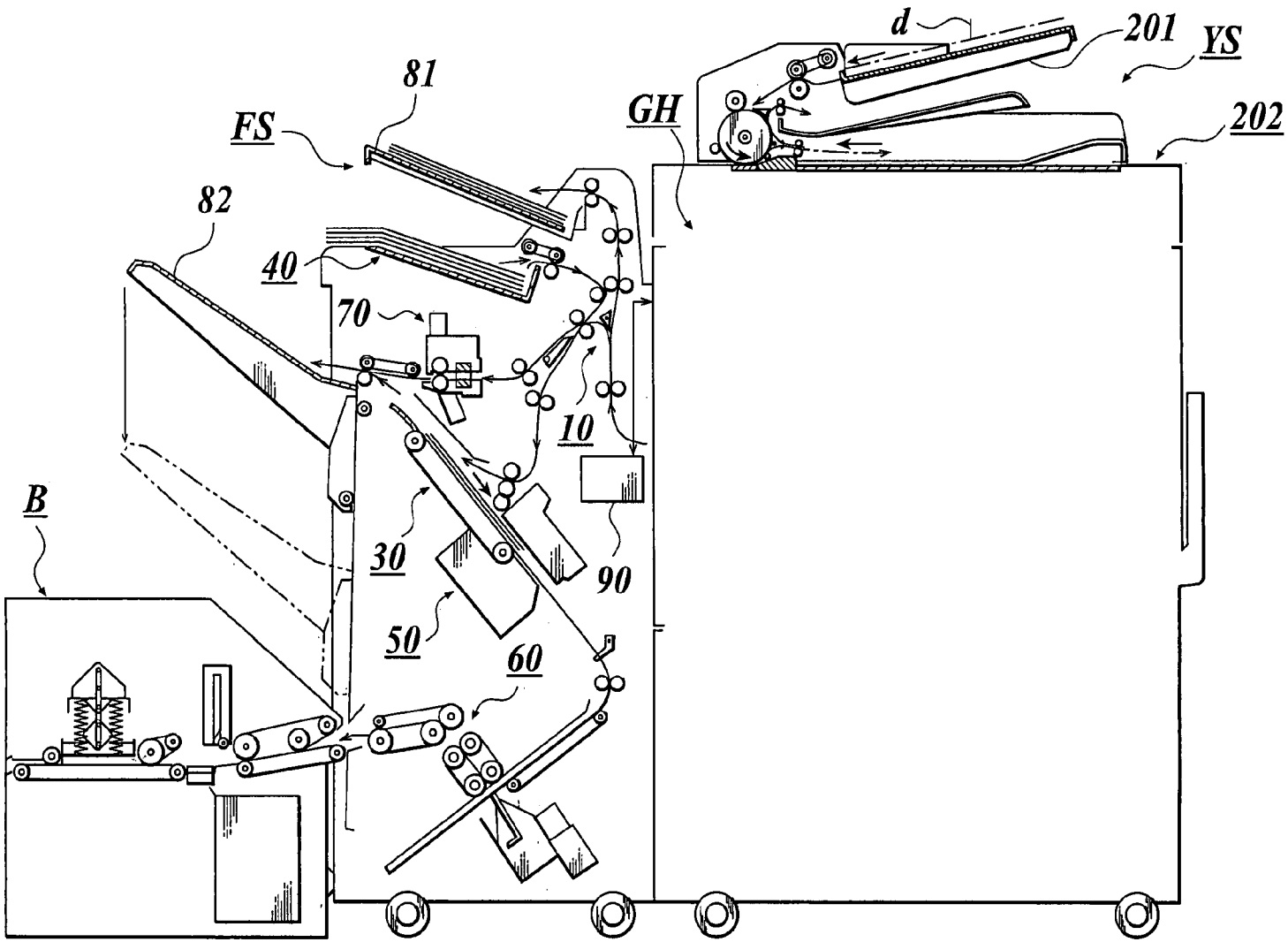
FIG. 3A and FIG. 3B are a conceptual diagram of a color copying machine which is one example of image forming apparatuses.
Figure 3B:
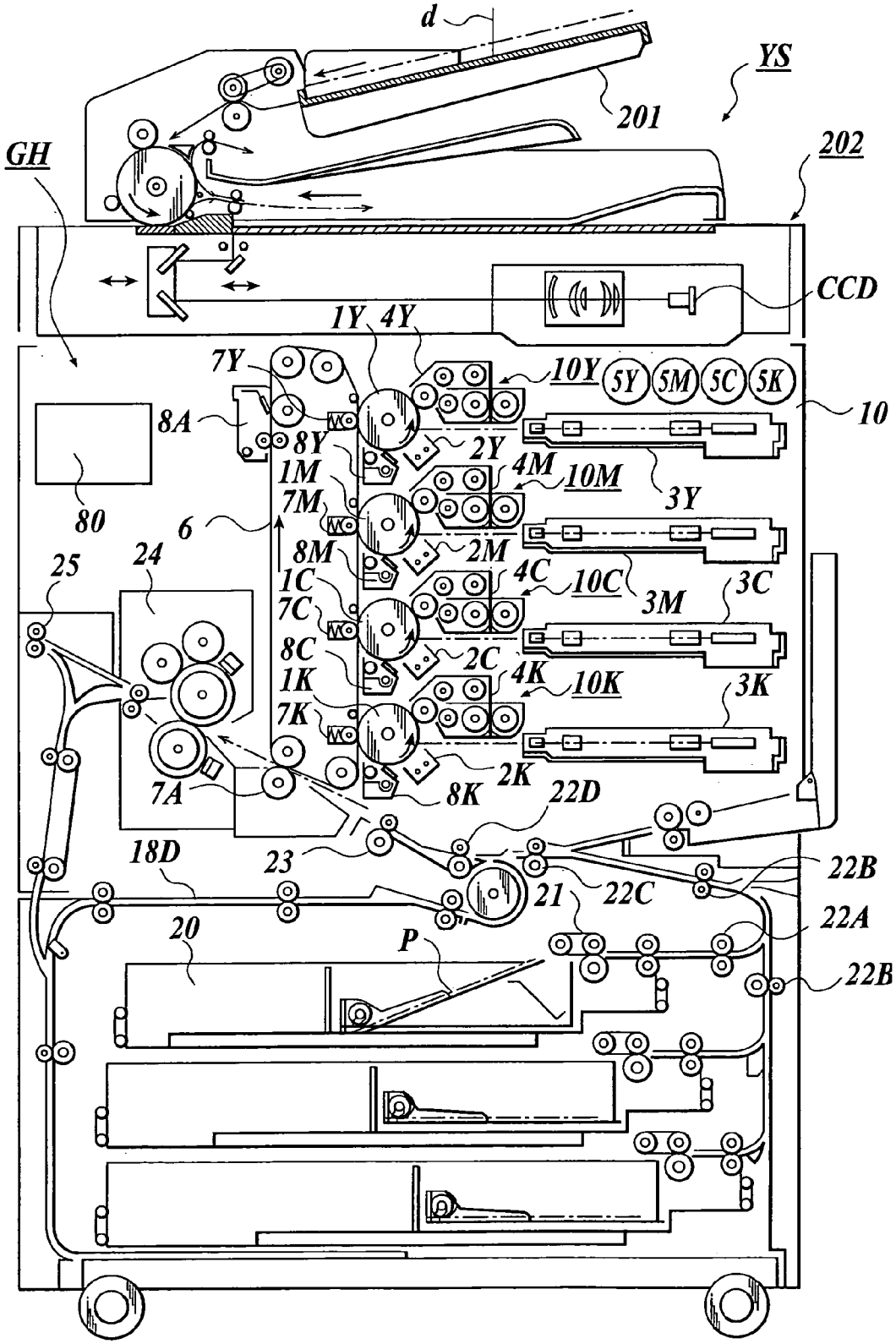

FIG. 3A and FIG. 3B are a conceptual diagram of a color copying machine which is one example of image forming apparatuses according to the embodiments of the invention.

An image forming apparatus main body GH is one called a tandem type color image forming apparatus, and comprises multiple sets of image forming sections, 10Y, 10M, 10C and 10K, a belt-shaped intermediate transfer body 6, a paper supply feeding member and a fixing unit 24. Also it comprises a post-treatment unit (finisher) FS and a cutting unit B. The image forming apparatus main body GH also comprises a feeding unit 18D for an automatic double-side copying (ADU).

An image forming section 10Y which forms yellow color images comprises a charging member 2Y, an exposure member 3Y, a development unit 4Y and a cleaning member 8Y disposed around a photoconductor 1Y as a picture forming body. An image forming section 10M which forms magenta color images comprises a photoconductor 1M as a picture forming body, a charging member 2M, an exposure member 3M, a development unit 4M and a cleaning member 8M. An image forming section 10C which forms cyan color images has a photocondictor 1C as a picture forming body, a charging member 2C, an exposure member 3C, a development unit 4C and a cleaning member 8C. An image forming section 10K which forms black color images has a photoconductor 1K as a picture forming body, a charging member 2K, an exposure member 3K, a development unit 4K and a cleaning member 8K. The charging member 2Y and the exposure member 3Y, the charging member 2M and the exposure member 3M, the charging member 2C and the exposure member 3C, and the charging member 2K and the exposure member 3K constitute latent image forming members.

The intermediate transfer body 6 is an endless belt, is extended by multiple rollers, and supported rotatably.

Respective color images formed by the image forming sections, 10Y, 10M, 10C and 10K are sequentially transferred onto the rotating intermediate transfer body 6 by the transfer members, 7Y, 7M, 7C and 7K (primary transfer), and a combined color image is formed. Paper P housed in a paper supply cassette 20 is supplied by a paper supply member 21, fed to a transfer member 7A via a paper supply roller 22A, 22B and 22C, and a resist roller 23, and the color image is transferred on the paper P (secondary transfer). The paper P on which the color image is transferred is fixed by the fixing unit 24, and sent to the post-treatment unit (finisher) FS by being interleaved to hold with a paper discharge roller 25.

Meanwhile, at the intermediate transfer body 6 form which paper P has been separated after transferring the color image on the paper P by the transfer member 7A, residual toner is eliminated by the cleaning member 8A.

5Y, 5M, 5C and 5K are toner resupply members which resupply new toner to the development units, 4Y, 4M, 4C and 4K, respectively.

On the upper section of the image forming apparatus main body GH, an image reading unit YS made up of an automatic document sending unit 201 and a document image scanning exposure unit 202 is installed. A document d placed on a document table of the automatic document sending unit 201 is fed by the feeding member, the image on one side or double sides is scanning-exposed by an optical system of the document image scanning exposure unit 202, and is read in a line image sensor CCD.

Analog treatment, A/D conversion, shading compensation, image compression and the like are given to analog signals, which is photoelectrically converted by the line image sensor CCD in an image processing section, and subsequently the signals are sent to an image writing section (exposure member), 3Y, 3M, 3C and 3K.

The automatic document sending unit 201 comprises an automatic double-sided document feeding member. This automatic document sending unit 201 can continuously read all at once contents of many sheets of documents d sent from the document table, and accumulate them in a memory member (electronic RDH function). Therefore, when document contents of many sheets are copied by a copying function or when many sheets of documents d are sent by a facsimile function, it is conveniently used.

At the post-treatment unit FS, from an upper part of the figure, a secured paper discharge plate 81, a front cover supply member 40, a shifting treatment feeding section 70, a first loading section 30, a staple member (stitch member) 50, and a second folding member 60 are disposed in column in an almost vertical direction.

At a right upper site of the post-treatment unit FS in the figure, a feeding member 10 is disposed. At left side face of the post-treatment unit FS in the figure, a rise and fall paper discharge plate 82 which loads recording paper S after end-stitch and shifting treatment is disposed.

As well, 80 is a control substrate which controls movement of the image forming apparatus main body GH, and 90 is a control circuit board which controls the post-treatment unit (finisher) FS and the cutting unit B.

EXAMPLES

Next, the configurations and the effects of the invention are illustrated on the basis of embodiments, but it is no doubt that the configurations of the invention are not limited thereto.

Preparation Example 1

(1) Preparation of Nuclear Particles (First Stage Polymerization)

In a separable flask of 5000 ml equipped with a stirring unit, a temperature sensor, a cooling tube and a nitrogen introducing unit, a surfactant solution (aqueous medium) where 7.08 g of anionic surfactant (sodium dodecylsulfonate: SDS) was dissolved in 3010 g of ion-exchange water is placed, and an internal temperature was raised to 60° C. under a nitrogen gas flow with stirring at a stirring speed of 230 rpm.

To this surfactant solution, initiator solution in which 9.2 g of polymerization initiator (potassium persulfate: KPS) is dissolved into 200 g of ion exchanged water was added, the temperature was made to 75° C., and subsequently a monomer mixture solution made up of 0.1 g of styrene, 19.9 g of n-butylacrylate and 10.9 g of methacrylic acid was dripped for over one hour. The polymerization (first stage polymerization) was performed by heating and stirring this system at 75° C. for over two hours to prepare latex (dispersion solution of resin particles made up of a high molecular weight resin). This is rendered "latex (1H)".

(2) Formation of Intermediate Layer (Second Polymerization)

In a flask equipped with a stirring unit, 56.0 g of a compound represented by the above formula 19) (melting point: 83° C. or below, referred to as "example compound (19)". hereinafter, use the same display manner) and 72 g of crystalline polyester (mp: 66° C., Mn: 3,300, acid value: 3.1 mg/KOH or less, referred to as "crystalline polyester (1)") obtained by reacting ethyleneglycol and succinic acid were added to a monomer mixture solution made up of 105.6 g of styrene, 30.0 g of n-butylacrylate, 6.4 g of methacrylic acid and 5.6 g of n-octyl-3-mercaptopropionate ester, heated to 60° C. and dissolved to prepare a monomer solution.

Meanwhile, a surfactant solution where 1.6 g of the anion surfactant (SDS) was dissolved in 2700 ml of ion-exchange water was heated to 60° C., and 28 g in terms of solid content of the latex (1H) which was the dispersion solution of nuclear particles was added to this surfactant solution. Subsequently, the monomer solution of the example compound (19) was mixed and dispersed by a mechanical dispersing machine, "Clearmix" (supplied from M Technique Co., Ltd.) having a circulation path to prepare a dispersion solution (emulsified solution) comprising emulsified particles (oil droplets) having a uniform dispersion particle diameter (28 nm).

Then, an initiator solution where 5.1 g of polymerization initiator (KPS) was dissolved in 240 ml of ion-exchange water and 750 ml of ion-exchange water were added to this dispersion solution (emulsified solution), and the polymerization (second stage polyirerization) was performed by heating and stirring this system at 60° C. for over three hours to yield latex (dispersion solution of composite resin particles of the structure where the surface of resin particles made up of the high molecular weight resin is coated with an intermediate molecular weight resin). This is rendered "latex (1HM)".

(3) Formation of Outer Layer (Third Stage Polymerization)

To the latex (1HM) obtained in the above way, an initiator solution where 7.4 g of the polymerization initiator (KPS) was dissolved in 200 ml of ion-exchange water was added, and under a temperature condition of 60° C., a monomer mixture solution made up of 300 g of styrene, 95 g of n-butylacrylate, 15.3 g of methacrylic acid and 10.4 g of n-octyl-3-mercaptopropionate ester was dripped for over one hour. After the completion of dripping, the polymerization (third stage polymerization) was performed by heating and stirring for over two hours, and the reaction was cooled to 28° C. to yield latex (dispersion solution of composite resin particles having a midmost made of the high molecular weight resin, an intermediate layer made of the intermediate molecular weight resin and an outer layer made up of the low molecular weight resin, where the example compound (19) is contained in the intermediate layer). This latex is rendered "latex (1HML)".

The composite resin particles which compose this latex (1HML) is those having peak molecular weights at 138,000, 80,000 and 13,000. The weight mean particle size of the composite resin particles was 122 nm.

Preparation Example 2

(1) Preparation of Nuclear Particles (First Polymerization)

In a flask equipped with a stirring unit, 72.0 g of the example compound (16) and 56.0 g of polyester (mp: 71° C., Mn: 4,300, acid value: 4.2 mg/KOH, hereinafter referred to as "crystalline polyester (2)") obtained by reacting 6-hexanediol and sebacylic acid were added to a monomer mixture solution made up of 105.6 g of styrene, 30.0 g of n-butylacrylate and 6.4 g of methacrylic acid, heated to 60° C. and dissolved to prepare a monomer solution.

Meanwhile, a surfactant solution where 1.6 g of the anion surfactant (SDS) was dissolved in 2700 ml of ion-exchange water was heated to 60° C., the monomer solution of the example compound (16) was mixed and dispersed in this surfactant solution by a mechanical dispersing machine, "Clearmix" (supplied from M Technique Co., Ltd.) having a circulation path to prepare a dispersion solution (emulsified solution) comprising emulsified particles (oil droplets) having a uniform dispersion particle diameter (268 nm).

Then, an initiator solution where 5.1 g of polymerization initiator (KPS) was dissolved in 240 g of ion-exchange water and 750 g of ion-exchange water were added to this dispersion solution (emulsified solution), and the polymerization (first stage polymerization) was performed by heating and stirring this system at 60° C. over three hours to yield latex (dispersion solution of resin particles made up of a high molecular weight resin). This is rendered "latex (2H)".

(2) Formation of Outer Layer (Second Stage Polymerization)

To the latex (2H) obtained in the above way, an initiator solution where 14.8 g of the polymerization initiator (KPS) was dissolved in 400 ml of ion-exchange water was added, and under a temperature condition of 60° C., a monomer mixture solution made up of 600 g of styrene, 190 g of n-butylacrylate, 30.0 g of methacrylic acid and 20.8 g of n-octyl-3-mercaptopropionate ester was dripped for over one hour. After the completion of dripping, the polymerization (second stage polymerization) was performed by heating and stirring for over two hours, and subsequently the reaction was cooled to 28° C. to yield latex (dispersion solution of composite resin particles having a midmost made of the high molecular weight resin and an outer layer made of the low molecular weight resin, where the example compound (16) is contained in the midmost). This latex is rendered "latex(1HL)".

The composite resin particles which compose this latex (1HL) is those having peak molecular weights at 168,000 and 11,000. The weight mean particle size of the composite resin particles was 126 nm.

Preparation Example 3

Latex (dispersion solution of composite resin particles having a midmost made of the high molecular weight resin, an intermediate layer made of the intermediate molecular weight resin and an outer layer made of the low molecular weight resin, where the crystalline compound (3) described below is contained in the intermediate layer) was yielded as is the case with the preparation example 1, except that the formation of the intermediate layer (second stage polymerization) was performed using 56 g of the crystalline polyester (mp: 97° C., Mn: 5,400, acid value: 2.4 mg/KOH or less, referred to as "crystalline polyester (3)") obtained by reacting 1,4-cyclohexanedimethanol and adipic acid, in place of the crystalline polyester (1). This latex is rendered "latex (3HML)".

The composite resin particles which compose this latex (3HML) is those having peak molecular weights at 138,000, 80,000 and 12,000. The weight mean particle size of the composite resin particles was 110 nm.

Preparation Example 4

Latex (dispersion solution of composite resin particles having a midmost made up of the high molecular weight resin, an intermediate layer made up of the intermediate molecular weight resin and an outer layer made up of the low molecular weight resin, where the crystalline compound (4) described below is contained in the intermediate layer) was yielded as is the case with the preparation example 1, except that the formation of the intermediate layer (second stage polymerization) was performed using 56 g of the crystalline polyester (mp: 58° C., Mn: 5,400, acid value: 0.4 mg/KOH, hereinafter referred to as "crystalline polyester (4)") obtained by reacting 1,8-octanediol and dodecenylsuccinic acid, in place of the crystalline polyester (1). This latex is rendered "latex (4HML)".

The composite resin particles which compose this latex (4HML) is those having peak molecular weights at 135,000, 78,000 and 14,000. The weight mean particle size of the composite resin particles was 100 nm.

Manufacture Example 1Bk

Sodium n-dodecylsulfate (59.0 g) was dissolved in 1600 ml of ion-exchange water with stirring. As this solution was stirred, 420.0 g of carbon black, "Regal 330" (supplied from Cabot Corporation) was gradually added, and then dispersion treatment was performed using "Clearmix" (supplied from M Technique Co., Ltd.) to prepare a dispersion solution of coloring agent particles (hereinafter, referred to as "coloring agent dispersion solution (Bk)"). When particle diameters of the coloring agent particles in this coloring agent dispersion solution were measured using an electrophoretic licht scattering spectrophotometer, "ELS-800" (supplied from Otsuka Electronics Co., Ltd.), the weight mean particle size was 98 nm.

The latex (1HML) obtained in the preparation example 1 (420 g in terms of solid content), 900 g of ion-exchange water, and 166 g of the coloring agent dispersion solution (Bk) were placed and stirred in a reaction container (four-necked flask) equipped with a temperature sensor, a cooling tube, a nitrogen introducing unit and a stirring unit. After adjusting the internal temperature to 30° C., an aqueous solution of sodium hydroxide at 5 mol/L was added to this solution to adjust the pH of the solution to 11.0.

Then, an aqueous solution where 12.1 g of magnesium chloride 6-hydrate was dissolved in 1000 ml of ion-exchange water was added for over 10 min at 30° C. under stirring. After leaving for 3 min, temperature rising was started, and this system was heated to 60° C. for over 6 min (temperature rising rate: 20° C./min).

In that state, particle sizes of associated particles were measured by "Coulter Counter TA-II". At the time point when the volume mean particle size became 5.5 μm, particle growth was stopped by adding an aqueous solution where 80.4 g of sodium chloride was dissolved in 1000 ml of ion-exchange water, and further fusion was continued by heating/stirring at a solution temperature of 60° C. for over 2 hours as a maturation treatment. Thereafter, the solution was cooled to 30° C. under a condition of 20° C./min, pH was adjusted to 2.0 by adding hydrochloric acid, and the stirring was stopped.

Colored particles with a volume mean particle size of 5.7 μm containing the crystalline polyester (1) were obtained by filtrating the produced associated particles, repeatedly washing with ion-exchange water and subsequently drying with warm air blow at 40° C. The colored particles obtained in this way are rendered "colored particles 1Bk".

Manufacture Example 2Bk

According to the formulation shown in the following Table 1, colored particles with a volume mean particle size of 5.6 μm containing the releasing agent [example compound (16)] were obtained as is the case with the manufacture example 1Bk, except that 420.7 g (in terms of solid content) of the latex (2HL) obtained in the preparation example 2 was used in place of the latex (1HML) and the time of maturation treatment was changed to 4 hours. The colored particles obtained in this way are rendered "colored particles 2Bk".

Manufacture Example 3Bk

According to the formulation shown in the following Table 1, colored particles with a volume mean particle size of 5.8 μm containing the crystalline compound (3) were obtained as is the case with the manufacture example 1Bk, except that 420.7 g (in terms of solid content) of the latex (3HML) obtained in the preparation example 3 was used in place of the latex (1HML). The colored particles obtained in this way are rendered "colored particles 3Bk".

Comparative Manufacture Example 1Bk

Colored particles with a volume mean particle size of 5.8 μm containing the crystalline compound (4) were obtained as is the case with the manufacture example 1Bk, except that the latex 4HML was used in place of the latex 1HML.

Comparative Manufacture Example 2Bk

Colored particles with a volume mean particle size of 5.8 μm containing the crystalline compound (1) were obtained as is the case with the manufacture example 1Bk, except that the fusion was continued by heating/stirring at the solution temperature of 96° C. over 8 hours as the maturation treatment.

Manufacture Example 1Y

Sodium n-dodecylsulfate (90 g) was dissolved in 1600 ml of ion-exchange water with stirring. As this solution was stirred, 42.0 g in terms of solid content of the pigment (water wet pigment paste of C.I. pigment yellow 180) was gradually added and then dispersion treatment was performed using "Clearmix" (supplied from M Technique Co., Ltd.) to prepare a dispersion solution of coloring agent particles (hereinafter referred to as "coloring agent dispersion solution (Y)"). When particle diameters of coloring agent particles in this coloring agent dispersion solution were measured using an electrophoretic light scattering spectrophotometer, "ELS-800" (supplied from Otsuka Electronics Co., Ltd.), the weight mean particle size was 250 nm.

Colored particles with a volume mean particle size of 5.6 μm containing the releasing agent [example compound (19)] were obtained as is the case with the manufacture example 1Bk, except that 166 g of the coloring agent dispersion solution (Y) was used in place of the coloring agent dispersion solution (Bk) and the time of maturation treatment was changed to 4 hours. The colored particles obtained in this way are rendered "colored particles 1Y".

Manufacture Example 2Y

According to the formulation shown in the following Table 1, colored particles with a volume mean particle size of 5.6 μm containing the releasing agent [example compound (16)] were obtained as is the case with the manufacture example 1Y, except that 420.7 g (in terms of solid content) of the latex (2HL) obtained in the preparation example 2 was used in place of the latex (1HML). The colored particles obtained in this way are rendered "colored particles 2Y".

Manufacture Example 3Y

According to the formulation shown in the following Table 1, colored particles with a volume mean particle size of 5.7 μm containing the crystalline polyester (1) were obtained as is the case with the manufacture example 1Y, except that 420.7 g (in terms of solid content) of the latex (3HML) obtained in the preparation example 3 was used in place of the latex (1HML). The colored particles obtained in this way are rendered "colored particles 3Y".

Comparative Manufacture Example 1Y

Colored particles with a volume mean particle size of 5.8 μm containing the crystalline polyester (4) were obtained as is the case with the manufacture example 1Y, except that the latex 4HML was used in place of the latex 1HML.

Comparative Manufacture Example 2Y

Colored particles with a volume mean particle size of 5.8 μm containing the crystalline polyester (1) were obtained as is the case with the manufacture example 1Y, except that the fusion was continued by heating/stirring at the solution temperature of 96° C. over 8 hours as the maturation treatment.

Manufacture Example 1M

Sodium n-dodecylsulfate (90 g) was dissolved in 1600 ml of ion-exchange water with stirring. As this solution was stirred, 26.3 g in terms of solid content of the pigment (C.I. pigment red 184 water wet pigment paste) was gradually added and then dispersion treatment was performed using "Clearmix" (supplied from M Technique Co., Ltd.) to prepare a dispersion solution of coloring agent particles (hereinafter referred to as "coloring agent dispersion solution (M)"). When particle diameters of coloring agent particles in this coloring agent dispersion solution were measured using an electrophoretic light scattering spectrophotometer, "ELS-800" (supplied from Otsuka Electronics Co., Ltd.), the weight mean particle size was 221 nm.

Colored particles with a volume mean particle size of 5.6 μm containing the crystalline polyester (1) were obtained as is the case with the manufacture example 1Bk, except that 166 g of the coloring agent dispersion solution (M) was used in place of the coloring agent dispersion solution (Bk) and the time of maturation treatment was changed to one hour. The colored particles obtained in this way are rendered "colored particles 1M".

Manufacture Example 2M

According to the formulation shown in the following Table 1, colored particles with a volume mean particle size of 5.8 μm containing the crystalline polyester (2) were obtained as is the case with the manufacture example 1M, except that 420.7 g (in terms of solid content) of the latex (2HL) obtained in the preparation example 2 was used in place of the latex (1HML). The colored particles obtained in this way are rendered "colored particles 2M".

Manufacture Example 3M

According to the formulation shown in the following Table 1, colored particles with a volume mean particle size of 5.6 μm containing the crystalline polyester (3) were obtained as is the case with the manufacture example 1M, except that 420.7 g (in terms of solid content) of the latex (3HML) obtained in the preparation example 3 was used in place of the latex (1HML). The colored particles obtained in this way are rendered "colored particles 3M".

Comparative Manufacture Example 1M

Colored particles with a volume mean particle size of 5.8 μm containing the crystalline polyester (4) were obtained as is the case with the manufacture example 1M, except that the latex 4HML was used in place of the latex 1HML.

Comparative Manufacture Example 2M

Colored particles with a volume mean particle size of 5.8 μm containing the crystalline polyester (1) were obtained as is the case with the manufacture example 1M, except that the fusion was continued by heating/stirring at the solution temperature of 96° C. for over 8 hours as the maturation treatment.

Manufacture Example 1C

Sodium n-dodecylsulfate (90 g) was dissolved in 1600 ml of ion exchange water with stirring. As this solution was stirred, 26.3 g in terms of solid content of the pigment (C.I. pigment blue 15:3 water wet pigment paste) was gradually added and then dispersion treatment was performed using "Clearmix" (supplied from M Technique Co., Ltd.) to prepare a dispersion solution of coloring agent particles (hereinafter referred to as "coloring agent dispersion solution (C)"). When particle diameters of coloring agent particles in this coloring agent dispersion solution were measured using an electrophoretic light scattering spectrophotometer, "ELS-800" (supplied from Otsuka Electronics Co., Ltd.), the weight mean particle size was 217 nm.

Colored particles with a volume mean particle size of 5.9 μm containing the releasing agent [example compound (19)] were obtained as is the case with the manufacture example 1Bk, except that 166 g of the coloring agent dispersion solution (C) was used in place of the coloring agent dispersion solution (Bk) and the time of maturation treatment was changed to one hour. The colored particles obtained in this way are rendered "colored particles 1C".

Manufacture Example 2C

According to the formulation shown in the following Table 1, colored particles with a volume mean particle size of 5.6 μm containing the releasing agent [example compound (16)] was obtained as is the case with the manufacture example 1C, except that 420.7 g (in terms of solid content) of the latex (2HL) obtained in the preparation example 2 was used in place of the latex (1HML). The colored particles obtained in this way are rendered "colored particles 2C".

Manufacture Example 3C

According to the formulation shown in the following Table 1, colored particles with a volume mean particle size of 5.6 μm containing the crystalline polyester (3) were obtained as is the case with the manufacture example 1C, except that 420.7 g (in terms of solid content) of the latex (3HML) obtained in the preparation example 3 was used in place of the latex (1HML). The colored particles obtained in this way are rendered "colored particles 3C".

Comparative Manufacture Example 1C

Colored particles with a volume mean particle size of 5.8 μm containing the crystalline polyester (4) were obtained as is the case with the manufacture example 1C, except that the latex 4HML was used in place of the latex 1HML.

Comparative Manufacture Example 2M

Colored particles with a volume mean particle size of 5.8 μm containing the crystalline polyester (1) were obtained as is the case with the manufacture example 1C, except that the fusion was continued by heating/stirring at the solution temperature of 96° C. for over 8 hours as the maturation treatment.

Hydrophobic silica (number mean primary particle diameter=10 nm, hydrophobing degree=63) at a percentage of 1.0% by weight was added to, and hydrophobic titanium oxide ((number mean primary particle diameter=25 nm, hydrophobing degree=60) at a percentage of 1.2% by weight was added to the colored particles 1Bk to 3Bk, the colored particles for comparison 1Bk and 2Bk, the colored particles 1Y to 3Y, the colored particles for comparison 1Y and 2Y, the colored particles 1M to 3M, the colored particles for comparison 1M and 2M, the colored particles 1C to 3C, and the colored particles for comparison 1C and 2C obtained as the above, and mixed by Henschel mixer to afford toners corresponding to respective colored particles.

With respect to these colored particles, the shapes and particle sizes thereof are not changed by the addition of hydrophobic silica and hydrophobic titanium oxide.

DSC curve was measured for respective colored particles to which hydrophobic silica and hydrophobic titanium oxide are added as described above. The results are shown in the following Table 1.

developers for comparison 1C and 2 C which respectively correspond to the colored particles 1Bk to 3Bk, the colored particles for comparison 1Bk and 2Bk, the colored particles 1Y to 3Y, the colored particles for comparison 1Y and 2Y, the colored particles 1M to 3M, the colored particles for comparison 1M and 2M, the colored particles 1C to 3C, and the colored particles for comparison 1C and 2C.

Examples 1 to 3 and Comparative Examples 1 and 2

OHP transparency, minimum fixing temperature and sticking of double sided image were evaluated by performing actual photographing tests where each developer and

TABLE 1

| | CRYSTALLINE COMPOUND | ACID VALUE OF CRYSTALLINE POLYESTER (mg/KOH) | LATEX | ADDITION AMOUNT BASED ON POLYMERIZABLE MONOMER OF CRYSTALLINE COMPOUND (mass %) | TYPE OF TONER | OF REDUCTION PEAK IN FIRST TEMPERATURE RISING PROCESS: LOCATION OF PEAK (° C.) | OF REDUCTION PEAK IN FIRST TEMPERATURE RISING PROCESS: ENDOTHERMIC QUANTITY (J/g) | ENDOTHERMIC QUANTITY OF REDUCTION PEAK IN SECOND TEMPERATURE RISING PROCESS (J/g) |
|---|---|---|---|---|---|---|---|---|
| FOR EXAMPLE 1 | CRYSTALLINE POLYESTER (1) | 3.1 | 1 HML | 11 | 1BK | 65 | 3.4 | 0.2 |
| | | | | | 1Y | 65 | 3.4 | 0.1 |
| | | | | | 1M | 65 | 3.3 | 0.2 |
| | | | | | 1C | 64 | 3.4 | 0.2 |
| FOR EXAMPLE 2 | CRYSTALLINE POLYESTER (2) | 4.2 | 2 HL | 5.8 | 2BK | 71 | 2.1 | 0.4 |
| | | | | | 2Y | 70 | 2 | 0.3 |
| | | | | | 2M | 71 | 2.1 | 0.3 |
| | | | | | 2C | 70 | 2.1 | 0.3 |
| FOR EXAMPLE 3 | CRYSTALLINE POLYESTER (3) | 2.4 | 3 HML | 11 | 3BK | 96 | 2.8 | 0.1 |
| | | | | | 3Y | 96 | 2.7 | 0.1 |
| | | | | | 3M | 97 | 2.8 | 0.1 |
| | | | | | 3C | 96 | 2.8 | 0.2 |
| FOR COMPARATIVE EXAMPLE 1 | CRYSTALLINE POLYESTER (4) | 0.4 | 4 HML | 11 | FOR COMPARISON 1BK | 58 | 2.5 | 2.2 |
| | | | | | FOR COMPARISON 1Y | 59 | 2.4 | 2.2 |
| | | | | | FOR COMPARISON 1M | 58 | 2.5 | 2.1 |
| | | | | | FOR COMPARISON 1C | 58 | 2.4 | 2.3 |
| FOR COMPARATIVE EXAMPLE 2 | CRYSTALLINE POLYESTER (1) | 3.1 | 1 HML | 11 | FOR COMPARISON 2BK | 65 | 0.3 | 0.2 |
| | | | | | FOR COMPARISON 2Y | 65 | 0.2 | 0.2 |
| | | | | | FOR COMPARISON 2M | 64 | 0.3 | 0.2 |
| | | | | | FOR COMPARISON 2C | 65 | 0.3 | 0.1 |

Respective colored particles to which hydrophobic silica and hydrophobic titanium oxide are added and ferrite carrier with a volume mean particle size of 60 μm coated with acryl resin were mixed to prepare developers with a toner concentration of 6% by weight.

These developers are rendered the developers 1Bk to 3BK, the developers for comparison 1BK and 2 BK, the developers 1Y to 3Y, the developers for comparison 1Y and 2 Y, the developers 1M to 3M, the developers for comparison 1M and 2 M, the developers 1C to 3C, and the each developer for comparison were used according to the combination shown in the above Table 1 and full color images (each pixel rate of Y/M/C/Bk is 50%) were continuously formed on double sides of transfer paper under high temperature and normal relative humidity (temperature: 33° C., relative humidity: 50%) by a modified machine of an intermediate transfer mode color copying machine "Konica 9128" (supplied from Konica Corporation) at 45 sheets per min equipped with an automatic double-side printing unit and a staple sorter.

OHP Transparency

Transparency (clearness) of the images was evaluated. The transparency of the OHP images was evaluated by the following method.

A transparent image (OHP image) was formed on OHP by the above image forming method using the developer of the invention or for comparison (fixing temperature: 170° C.), and evaluated by the method shown below. An adhering amount of the toner was evaluated in the range of 0.7±0.05 ($mg/cm^2$).

For the fixed image, a visible spectral transmittance of the image was measured by "330 type self-recording spectrophotometer" supplied from Hitachi Ltd., in reference to the transparency of an OHP sheet on which the toner was not supported. A difference of spectral transmittance at 650 nm and 450 nm for the yellow toner, a difference of spectral transmittance at 650 nm and 550 nm for the magenta toner and a difference of spectral transmittance at 500 nm and 600 nm for the cyan toner were obtained to make scales for the transparency of the OHP images. When this value is 70% or more, it can be judged to be good transparency.

Minimum Fixing Temperature

With respect to respective fixed images formed by changing (raising) the temperature of the heating roller (fixing temperature) up to 120 to 200° C. by 5° C., a fixation rate was measured, and the temperature of the heating roller at which the fixation rate reached 90% as shown below was rendered a minimum fixing temperature.

When the temperature is 165° C. or below, it is good.

Sticking of Double Sided Image

Fifty sheets of double-side printed images were discharged, and left until the temperature was 30° C. or below. Subsequently paper was flipped sheet-by-sheet, and sticking was evaluated by the following criteria. For a discharge temperature of paper, the discharge temperature was measured by inserting a thermocouple between papers at the time point when 20 sheets were discharged.

A: No sticking at all;

B: Crispy sound when the paper is peeled but no stain on images;

C: One image is transferred to the other image with stain when the paper is peeled.

TABLE 2

| | TRANSPARENCY | | | MINIMUM FIXATION TEMPERATURE (° C.) | STICKING OF DOUBLE SIDED IMAGES |
|---|---|---|---|---|---|
| | YELLOW | MAGENTA | CYAN | | |
| EXAMPLE 1 | 94 | 93 | 92 | 125 | A |
| EXAMPLE 2 | 87 | 85 | 84 | 140 | A |
| EXAMPLE 3 | 78 | 75 | 76 | 160 | A |
| COMPARATIVE EXAMPLE 1 | 54 | 51 | 50 | 145 | C |
| COMPARATIVE EXAMPLE 2 | 68 | 67 | 65 | 195 | B |

It is shown that all properties have sufficient performances in the examples 1 to 3 of the invention but there are many properties with problems in the comparative examples 1 and 2 out of the invention.

What is claimed is:

1. A toner comprising:

a crystalline compound comprising crystalline polyester having an acid value from 1 to 8 mg/KOH and form 3 to 40% by weight based on the toner; a binding resin; and a coloring agent, wherein a differential heat quantity curve measured by a differential scanning calorimeter has a clear endothermic peak at 50 to 100° C. in a first temperature rising process, and in a second temperature rising process, a peak area of the endothermic peak is reduced by ⅓ or less with respect to the peak area of the endothermic peak in the first temperature rising process.

2. The toner of claim 1, wherein the binding resin comprises a monomer having a carboxyl group.

3. The toner of claim 1, wherein a peak value of the endothermic peak is 5 J/g or more in the first temperature rising process, and is less than 0.7 J/g in the second temperature rising process.

4. The toner of claim 1, wherein a melt viscosity, which is a melt viscosity at a melting point+20° C., of the crystalline polyester is 300 dPa·s or less.

5. The toner of claim 4, wherein a peak temperature of endothermic peak of which the peak area is reduced in the second temperature rising process is from 55 to 70° C. in the first temperature rising process.

6. The toner of claim 1, wherein a peak temperature is in the first temperature rising process of the endothermic peak of which the peak area is reduced in the second temperature rising process is from 55 to 70° C.

7. The toner of claim 6, wherein the peak temperature of the endothermic peak in the first temperature rising process is from 58 to 65° C.

8. The toner of claim 1, wherein the toner is obtained by associating fine particles formed by polymerizing a monomer composition comprising the crystalline compound and a polymerizable monomer in an aqueous phase.

9. The toner of claim 1, comprising a chromatic color coloring agent.

10. The toner of claim 1, wherein a peak value of the endothermic peak in the first temperature rising process is 2 J/g or more.

11. The toner of claim 10, wherein the peak value of the endothermic peak is 5 J/g or more.

12. The toner of claim 1, wherein a peak value of the endothermic peak in the first temperature rising process becomes less than 0.7 J/g in the second temperature rising process.

13. The toner of claim 12, wherein the peak value of the endothermic peak becomes less than 0.5 J/g in the second temperature rising process.

14. The toner of claim 1, wherein number average molecular weight of the crystalline compound is from 1500 to 15,000.

15. An image forming method comprising:

developing a latent image on a photoreceptor with the toner as defined in claim 1to form a toner image; and fixing the toner onto an image support by heat.

16. The image forming method of claim 15, comprising:

developing latent images with toners including a black toner and a chromatic toner to form toner images, wherein at least one of the toners are the toner as defined in claim 1; and forming a color image by overlapping toner images.

17. The image forming method of claim 15, comprising:

developing latent images with toners including a black toner and a chromatic toner to form toner images, wherein at least one of the toners are the toner as defined in claim 1; and forming a color image by overlapping toner images.

* * * * *